US006274300B1

(12) United States Patent
Seki

(10) Patent No.: US 6,274,300 B1
(45) Date of Patent: Aug. 14, 2001

(54) CONCENTRATED LIQUID COLOR DEVELOPER COMPOSITION FOR SILVER HALIDE COLOR PHOTOGRAPHIC MATERIAL AND DEVELOPMENT PROCESSING METHOD

(75) Inventor: Hiroyuki Seki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/631,382

(22) Filed: Aug. 3, 2000

(30) Foreign Application Priority Data

| | | |
|---|---|---|
| Aug. 4, 1999 | (JP) | 11-221478 |
| Sep. 29, 1999 | (JP) | 11-277005 |
| Jun. 2, 2000 | (JP) | 12-165891 |
| Jun. 2, 2000 | (JP) | 12-165892 |

(51) Int. Cl.[7] ..... G03C 7/413
(52) U.S. Cl. ..... 430/466
(58) Field of Search ..... 430/466

(56) References Cited

U.S. PATENT DOCUMENTS

| | | | | |
|---|---|---|---|---|
| 2,784,086 | | 3/1957 | Henn | 430/466 |
| 3,574,619 | | 4/1971 | Surash | 430/466 |
| 3,647,461 | | 3/1972 | Surash et al. | 430/466 |
| 3,814,606 | | 6/1974 | Ozawa et al. | 430/466 |
| 4,155,762 | * | 5/1979 | Matsuda et al. | 430/141 |
| 5,362,610 | * | 11/1994 | Yoshimoto | 430/465 |
| 5,641,615 | * | 6/1997 | Haye et al. | 430/430 |
| 5,914,221 | * | 6/1999 | Kim | 430/466 |
| 6,174,654 | * | 1/2001 | Hagiwara et al. | 430/493 |

* cited by examiner

*Primary Examiner*—Hoa Van Le
(74) *Attorney, Agent, or Firm*—Sughrue, Mion, Zinn, Macpeak & Seas, PLLC

(57) ABSTRACT

A concentrated liquid color developer composition for a silver halide color photographic material which comprises at least one compound represented by the following formula (I) or (II):

$$R^1—(OC_2H_4)_n—OH \quad (I)$$

wherein $R^1$ represents an alkyl group having from 1 to 3 carbon atoms, and n represents an integer of from 4 to 9;

$$R^2—SO_3M \quad (II)$$

wherein $R^2$ represents an alkyl group having from 4 to 10 carbon atoms, and M represents a cation.

5 Claims, 2 Drawing Sheets

CONCENTRATED LIQUID COLOR DEVELOPER COMPOSITION FOR SILVER HALIDE COLOR PHOTOGRAPHIC MATERIAL AND DEVELOPMENT PROCESSING METHOD

FIELD OF THE INVENTION

The present invention relates to a concentrated liquid color developer composition for use for processing a silver halide color photographic material and a development processing method using the same. More specifically, the present invention relates to a development processing method capable of effectively preventing crystals from creeping over the wall of a color developing tank and contamination of a color developing tank due to tars from occurring, and also capable of well preventing precipitation of crystals from a developing kit.

BACKGROUND OF THE INVENTION

The processing of a silver halide photographic material, e.g., a silver halide color photographic material, in general, comprises a color developing step (i.e., a color forming development step) a desilvering step and an image stabilizing step, e.g., a water washing step, as fundamental steps. In a color developing step, an imagewise dye and a developed silver are formed by the reaction of a color developing agent and a silver salt. In a desilvering step, the developed silver formed in a color developing step is oxidized (bleached) by a bleaching agent having an oxidizing function and becomes a silver salt, and removed from a photosensitive layer together with unused silver halide by a fixing agent which forms a soluble salt. Alternatively, the oxidation to a silver salt and the removal thereof are performed through a single step by means of a blixing solution. An image stabilizing step is a step for adjusting the atmosphere of an image layer for securing the stability of the image formed for a long period of time and comprises washing with water, washing with water and image stabilizing bath, or stabilizing bath substituting for washing.

Each processing step exclusive of water washing is performed using an aqueous solution (called a processing solution) containing one or more processing chemicals. Since each processing solution is relatively in low concentration, it is generally inappropriate in view of economical point, storage space and workability that manufacturers produce processing solutions in a workable state and transport them to a processing laboratory and the processing laboratory stores them.

For coping with this problem, two ways have been conventionally used, i.e., one is a way that processing chemicals constituting a processing solution are prepared in a mixture of powder chemicals compounded in the ratio according to the composition of the processing solution, and the mixture is supplied to a developing laboratory in the form of a packaged solid processing agent, and the solid processing agent is dissolved with water and diluted to appropriate concentration to make a processing solution before use in the developing laboratory, and another is a way that constituting processing chemicals are dissolved in high concentration, packed in a container in the form of a concentrated liquid processing agent and supplied to a developing laboratory, and the concentrated liquid processing agent is diluted with water and the like to a prescribed concentration to make a processing solution before use in the developing laboratory.

Solid processing agents are advantageous in view of transporting cost and storage space but are inconvenient in that they should be dissolved in a developing laboratory, dusts of chemicals are scattered, and chemicals must be mixed uniformly, and disadvantageous in that liquid chemicals must be contained in separate bottles (containers of processing agents) at ordinary temperature and combined with powder chemicals of separate packages respectively.

On the other hand, concentrated liquid processing agents are largely advantageous in that the work of dissolution in a developing laboratory can be omitted but do not come up with solid processing agents in the point of transportation and storage. Thus, solid processing agents and liquid processing agents have both advantages and disadvantages respectively, and no processing agents have been found which satisfy all of economical and environmental sides such as the reduction of the volume of processing agents, the reduction of waste containers, the saving of storage space, and the reduction of transporting costs, and simplicity from working side such as labor saving of the work of preparation of processing solutions, and safety.

In recent years, in the improvement of solid processing agents, although a certain progress has been made such that a method of forming a processing agent in the form of tablets has been disclosed (e.g., Canadian Patent 831,928), but as the development processing agent for use in a developing laboratory, concentrated liquid processing agents are more desired from the easiness of working and the purpose of improving the productivity of development processing. Therefore, it is desired to further enhance the degree of concentration of liquid processing agents and give compactness as solid processing agents to liquid processing agents. However, for stably storing concentrated liquid processing agents and generating no hindrance at use, concentrated liquid processing agents should be a homogeneous solution having saturation solubility or less, hence further thickening of solutions is very difficult.

Concerning concentrated liquid processing agents, pasting of black-and-white development processing solutions has been known for long and pasting of color developers is also conducted for the purpose of concentration and from other various purposes. For example, pasting of a color developer has been tried by using an alginic acid derivative as a thickening imparting agent, i.e., a thickener, and the application techniques to a concentrated liquid processing agent for a color photographic material are also disclosed. However, the pasting of color developers is not to heighten the degree of concentration of the processing chemicals by increasing the solubility but merely to delay precipitation or delay the agglomeration and solidification of insoluble matters even if precipitation occurs. Therefore, although pasting has the effect of prolonging the useful life of processing chemicals a little, it cannot essentially solve the problem to reduce the volume of processing chemicals, hence pasting is not a technique of developing the advantage of liquid processing agents.

The liquid processing agents for a color photographic material consist of a color developer, a bleaching agent and a fixing agent or a blixing agent, and a stabilizing solution. Of these processing agents, a color developer contains a p-phenylenediamine derivative as a developing agent, and since this developing agent is relatively in low concentration, thickening is largely restricted such that the developing agent is liable to precipitate during preservation. In addition, since the developing agent is susceptible to air oxidation, deterioration of the developing agent progresses with the lapse of time during preservation. As a result, the air oxidized developing agent becomes tar-like substance and adheres to the wall of a container, which hinders the reclaim and reuse of the container. Thus the concentrated liquid developer has various problems of the precipitation of the developing agent due to restriction on solubility, the air oxidation of a color developing agent during preservation, and the resulting coloring contamination of a container.

The prevention of precipitation of the color developing agent is disclosed in various patent specifications including JP-A-6-194797 (the term "JP-A" as used herein means an "unexamined published Japanese patent application"), e.g., methods of adding N,N-di-substituted aniline derivatives, alkyldiphenyl ether disulfonic acids, anionic surfactants, aromatic sulfonic acids, p-toluenesulfonic acids or alkanolamines alone or in combination are disclosed. Any of these methods certainly shows the precipitation prevention effect but the effect is not sufficient, thus these methods are not the means to essentially solve the problem.

Further, for preventing the air oxidation of the color developing solution, the development of more effective preservatives than hydroxylamine salts conventionally used has been promoted. Dialkylhydroxylamines and hydroxylalkyl-hydrazines having a larger preserving effect are disclosed in JP-A-4-443. The preserving effect has been improved by these preservatives but still further advancement has been required.

As mentioned above, for the improvement of the use aptitude of the concentrated liquid development processing agent, the prevention of precipitation of the color developing agent, i.e., the improvement of the solubility and the storage stability has been strongly desired.

As a means to solve such a kind of problem, it is disclosed in JP-A-11-174643 that ethyleneurea has an excellent precipitation prevention effect of the developing agent in the concentrated liquid development processing agents. Therefore, as such a precipitation preventing agent, the realization of precipitation prevention effect of the same with or more than ethyleneurea is required.

As the above concentrated liquid development processing agent is diluted to prepare a color developing solution or a color developing replenisher and a silver halide color photographic material is color development-processed in a color developing tank, the components of the color developing solution precipitate as color development is continued, which causes a phenomenon that the precipitated crystals of the components of the color developing solution creep over the wall of the developing tank, or the contamination by tar is generated on the wall of the developing tank, followed by the reduction of the processing activity of the color developing solution. The methods to solve these problems are also required.

SUMMARY OF THE INVENTION

Accordingly, a first object of the present invention is to provide a concentrated liquid developer composition for a color photographic material which does not generate precipitation of insoluble matters during storage, does not cause coloring of the processing solution and the container of the processing solution due to air oxidation, and does not cause the deterioration of photographic performances even if a high concentration of color developing agent may be contained.

A second object is to provide a concentrated liquid developer composition which is contained in a container so that the contained developer composition can be stored stably for a long period of time.

A third object is to provide a color development processing method capable of easily handling the concentrated liquid developer composition contained in a container and stably maintaining the quality of the developer composition.

A fourth object is to provide a color development processing method capable of easily preventing crystals from creeping over the wall of a color developing tank and contamination of a color developing tank due to tars from occurring.

These objects of the present invention have been accomplished by the following composition of the concentrated liquid processing agent for color development, the form to contain the concentrated liquid processing agent in a container and the development processing method.

(1) A concentrated liquid color developer composition for a silver halide color photographic material which comprises at least one compound represented by the following formula (I) or (II):

$$R^1—(OC_2H_4)_n—OH \quad (I)$$

wherein $R^1$ represents an alkyl group having from 1 to 3 carbon atoms, and n represents an integer of from 4 to 9;

$$R^2—SO_3M \quad (II)$$

wherein $R^2$ represents an alkyl group having from 4 to 10 carbon atoms, and M represents a cation.

(2) The concentrated liquid color developer composition as described in the above item (1), wherein said concentrated liquid color developer composition contains at least one compound represented by formula (II), and at least one compound selected from polyethylene glycol (provided that the polyethylene glycol has a number average molecular weight of 2,000 or less), ureas, and polyvinyl pyrrolidones.

(3) The concentrated liquid color developer composition as described in the above item (1) or (2), wherein said concentrated liquid color developer composition is contained in a container.

(4) A development processing method of a silver halide color photographic material which comprises performing color development using a color developing solution or a color developing replenisher obtained by diluting the concentrated liquid color developer composition described in the above item (1), (2) or (3) within processing time of 2 minutes and 30 seconds.

(5) A development processing method of a silver halide color photographic material which comprises performing color development using a color developing solution or a color developing replenisher obtained by diluting the concentrated liquid color developer composition described in the above item (1), (2) or (3) at processing temperature of 40° C. or more.

The present invention has been achieved on the basis of the knowledge that when the concentrated liquid color developer composition contains at least one compound represented by formula (I) or (II) with a color developing agent, even if the color developing agent may be contained in high concentration, insoluble matters do not precipitate during storage, the concentrated liquid color developer composition is unsusceptible to air oxidation, as a result, the stability of the color developer composition is improved, the coloring of the processing solution and the container of the processing solution due to air oxidation of the developing agent is difficult to occur including the period of storage until the color development processing agent is used, further when a photographic material is processed in a developing tank, creeping over the wall of a color developing tank by the precipitated crystals and contamination of a color developing tank due to tars are effectively prevented, and the deterioration of photographic performances are reduced.

"Concentrated liquid color developer composition" used in the present invention means a concentrated liquid processing agent suitable to be contained in a container in a concentrated liquid state by dissolving processing chemicals in high concentration to be supplied to a developing laboratory, and is differentiated from the so-called solid processing agent. The concentrated liquid color developer composition according to the present invention is generally diluted with water, etc., to the prescribed concentration at a developing laboratory and used as a processing solution. The concentrated liquid color developer composition may be put in a processing tank after being diluted or may be put in a processing tank separately from dilution water and diluted therein to make a processing solution.

According to the present invention, by the addition of a compound represented by formula (I) or (II) to a color developing solution, the precipitation of the color developing agent can be inhibited, as a result, it becomes possible to design a processing agent composition having high concentration. Conveniently enough, a compound represented by formula (I) or (II) has the effect of preventing the coloring of a processing solution and the wall of the container of a processing solution due to air oxidation of a developing solution. The mechanism of the coloring prevention is not clearly known, but it can be presumed that this is contributed to the fact that as a result of the prevention of the precipitation of a developing agent, the insoluble developing agent susceptible to oxidation runs out. Since the developing agent in the color developing solution does not precipitate, does not oxidize and is stably retained in the concentrated liquid color developer composition, photographic properties are not deteriorated with the lapse of time and the storage stability of he processing agent composition can be improved. Moreover, in the processing of a color photographic material, creeping of the precipitated crystals over the wall of a color developing tank and the contamination of a color developing tank due to tars are effectively prevented.

When the concentration of a developing agent is increased or the temperature of color development processing is raised for the purpose of shortening color development processing time, the development of the upper photosensitive layer advances to excess as compared with that of the lower photosensitive layer, i.e., the so-called color balance becomes worse. Contrary to this, it has been found that when the concentrated liquid development processing agent of the present invention is diluted and used as a color developing solution or a color developing replenisher, the worsening of the above color balance in rapid development can be improved.

In particular, this effect is effectually exhibited in rapid and/or high temperature color development processing of 2 minutes and 30 seconds or less and/or 40° C. or more.

Above all, when the concentrated liquid color developer composition contains, with a color developing agent, at least one compound represented by formula (II), and at least one compound selected from polyethylene glycol (provided that the polyethylene glycol has a number average molecular weight of 2,000 or less), ureas, and polyvinyl pyrrolidones, the effects of preventing the coloring of a container, the creeping of the precipitated crystals over the wall of a color developing tank, the contamination of a color developing tank by tars, and the resulting deterioration of photographic performances are conspicuous. In particular, since the effect of preventing the worsening of the color balance attributable to the unbalance of the development progress of the lower layer and the upper layer is increased due to the above constitution of the present invention, further shortening of the processing time can be contrived.

BRIEF DESCRIPTION OF THE ACCOMPANYING DRAWINGS

KEY TO THE SYMBOLS

Figure 1:
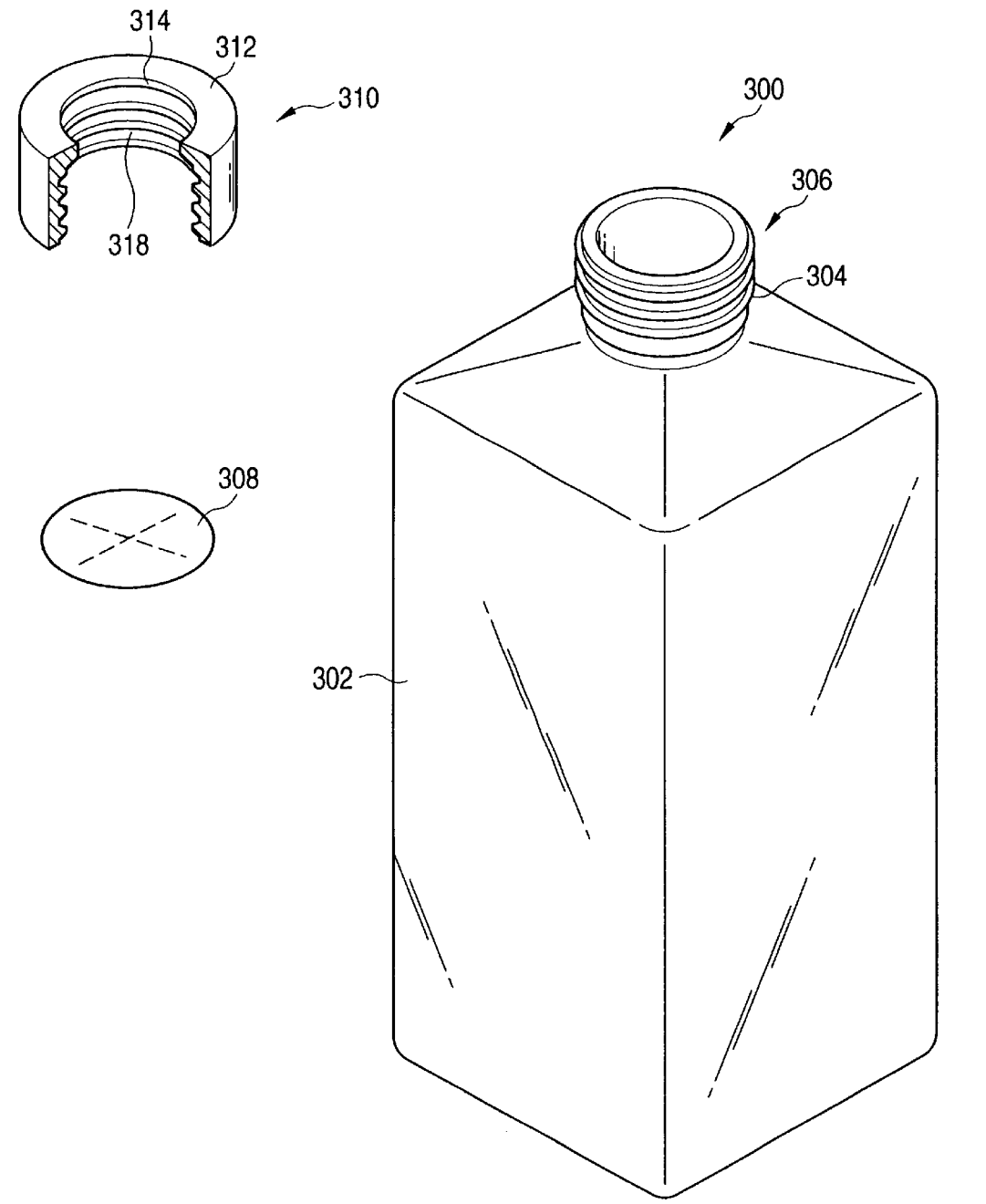
FIG. 1 is a view of a container (bottle) of a processing agent composition in one embodiment of the present invention.

188: Punching nozzle
214: Nozzle hole
300: Bottle (a container of a photographic processing agent)
302: Container body
304: External thread (threaded portion)
308: Polyethylene sheet with cutting slots
310: Cap (a fixed member)
312: Bottom (when loaded)
314: Opening

DETAILED DESCRIPTION OF THE INVENTION

The present invention will be described further in detail below.

Specific examples of the compounds represented by formula (I) include the compounds shown below. Of these compounds, (I-3), (I-4), (I-5), (I-9), (I-10) and (I-11) are preferred.

Compounds Represented by Formula (I)

| | |
|---|---|
| (I-1) | $CH_3—(OC_2H_4)_4—OH$ |
| (I-2) | $CH_3—(OC_2H_4)_5—OH$ |
| (I-3) | $CH_3—(OC_2H_4)_6—OH$ |
| (I-4) | $CH_3—(OC_2H_4)_7—OH$ |
| (I-5) | $CH_3—(OC_2H_4)_8—OH$ |
| (I-6) | $CH_3—(OC_2H_4)_9—OH$ |
| (I-7) | $C_2H_5—(OC_2H_4)_4—OH$ |
| (I-8) | $C_2H_5—(OC_2H_4)_5—OH$ |
| (I-9) | $C_2H_5—(OC_2H_4)_6—OH$ |
| (I-10) | $C_2H_5—(OC_2H_4)_7—OH$ |
| (I-11) | $C_2H_5—(OC_2H_4)_8—OH$ |
| (I-12) | $C_2H_5—(OC_2H_4)_9—OH$ |
| (I-13) | $C_3H_7—(OC_2H_4)_4—OH$ |
| (I-14) | $C_3H_7—(OC_2H_4)_5—OH$ |
| (I-15) | $C_3H_7—(OC_2H_4)_6—OH$ |
| (I-16) | $C_3H_7—(OC_2H_4)_7—OH$ |
| (I-17) | $C_3H_7—(OC_2H_4)_8—OH$ |
| (I-18) | $C_3H_7—(OC_2H_4)_9—OH$ |

Specific examples of the compounds represented by formula (II) include the compounds shown below. Of these compounds, (II-3), (II-4), (II-5), (II-9), (II-10) and (II-11) are preferred.

Compounds Represented by Formula (II)

| | |
|---|---|
| (II-1) | $CH_3—(CH_2)_4—SO_3Na$ |
| (II-2) | $CH_3—(CH_2)_5—SO_3Na$ |
| (II-3) | $CH_3—(CH_2)_6—SO_3Na$ |
| (II-4) | $CH_3—(CH_2)_7—SO_3Na$ |
| (II-5) | $CH_3—(CH_2)_8—SO_3Na$ |
| (II-6) | $CH_3—(CH_2)_9—SO_3Na$ |

-continued

| | |
|---|---|
| (II-7) | $CH_3—(CH_2)_{10}—SO_3Na$ |
| (II-8) | $CH_3—(CH_2)_4—SO_3H$ |
| (II-9) | $CH_3—(CH_2)_6—SO_3H$ |
| (II-10) | $CH_3—(CH_2)_8—SO_3H$ |
| (II-11) | $CH_3—(CH_2)_6—SO_3K$ |
| (II-12) | $CH_3—(CH_2)_8—SO_3K$ |

As already described above, the compositional characteristic of the concentrated developer composition according to the present invention is that the composition can be thickened in extremely high concentration and the technical characteristic is that the restrictions of the thickening have been overcome. The degree of concentration of the concentrated developer composition according to the present invention is from 1.5 to 10 times, preferably from 2 to 8 times, and more preferably from 3 to 5 times, of the solution in working state, i.e., the developing replenisher or the mother solution (the tank solution). The concentration of the compound represented by formula (I) and/or (II) (the total concentration when two or more compounds are contained) is from 0.01 to 200 g, preferably from 1 to 100 g, and more preferably from 5 to 50 g, per liter of the concentrated developer composition.

It is advantageous that the concentrated developer composition according to the present invention take the form that all the components to be contained in a working solution is contained in one composition, i.e., one-part constitution, but the constitutional components may be separated to two or more liquid parts to make a developer composition of two-part or three-part constitution when it is not preferred for the constitutional components to be kept in contact with each other for a long period of time (generally called as one-part, two-part or three-part constitution according to International Standard, ISO 5989), and the effect and the characteristics of the present invention are not lost by dividing the concentrated developer composition to some parts. The developer composition according to the present invention is particularly preferably used as one-part constitution.

The container for the concentrated liquid developer according to the present invention will be described below. It is advantageous in the present invention that the developer can be supplied with being contained in a polyethylene container.

In general, a liquid developer composition is contained in an appropriate container and transported, stored and used. The first requisite as to the material of a developer container is that it should be inactive to the developer composition and sufficiently stable (requisite 1). The requisite as important as requisite 1 is that the container must have sufficient oxygen barrier property not to cause air oxidation (requisite 2) throughout the period from the production of the developer composition to the use thereof. An additional desired condition is that the waste container is recyclable (requisite 3). Since the development activity of the concentrated liquid development processing agent is reduced with the lowering of the pH during storage, it is preferred to avoid contact with carbon-dioxide in the air. Therefore, the material of the container should be such that the container wall has impermeability to carbon dioxide (requisite 4) as well as oxygen barrier. Almost all the materials which satisfy requisite 2 also satisfy requisite 4.

From the viewpoint of requisites 2 and 4, it is advantageous to put a developer composition into an oxygen- and carbon dioxide-barrier container and preserve and transport it. From the practical useful life of a developer composition, it is preferred to design the material and the thickness of a container so that the air permeation rate of unit time per unit area in the air of normal temperature and normal pressure becomes $2.5\times10^{-7}$ $cm^3/cm^2/sec/atm$ or less, preferably $2.5\times10^{-8}$ $cm^3/cm^2/sec/atm$ or less. On the other hand, from the viewpoint of requisite 4, containers of the materials having the permeation rate to carbon dioxide of the container wall of $7\times10^{-7}$ $cm^3/cm^2/sec/atm$ or less have been thought to be desired. Therefore, materials of the container have been largely restricted.

From the point of impermeability to gases, liquid development processing agents were in many cases put in a glass bottles and supplied in a sealed state at the beginning. However, since glass bottles are heavy in weight and liable to be broken, bottles made of laminated materials comprising plastics having a high property of gas barrier and plastics stable to alkaline developers have come to be used in general. Although these well-known composite plastic materials effectively exclude air to prevent air (oxygen) oxidation, and increase the storage stability of liquid developers, it is difficult, on the other hand, to reclaim the containers on account of being composite materials and they are discarded as non-returnable containers at every use, which increases environmental load.

Since the color developing solutions containing a compound represented by formula (I) or (II) are advantageous in that they are insusceptible to air oxidation as described above, practical storage stability can be obtained without using such composite material containers. The materials of the plastic containers which are suited for the present invention may have air permeation rate of 10 times higher than the above-described value, hence even single item plastics satisfying the above requisites 2 and 4 can be selected. That requisite 3 can be easily satisfied by using single item plastics is one characteristic advantage of the present invention.

Especially big advantage is that polyethylene, which has not conventionally been used due to its insufficient property of barrier to air although it can be recycled easily, has practicable protecting property as a container of the liquid developer according to the present invention.

Preferred examples of the materials for the container of the color developer of the present invention include polyester resin, acrylate resin, ABS resin, epoxy resin and polyamide resin such as nylon, polyurethane resin, polystyrene resin, polycarbonate resin, PVA, polyvinyl chloride, polyvinylidene chloride, and polyethylene resin. Of these, containers consisting of polyester resin such as polyethylene terephthalate or polyethylene naphthalate, or polyolefin resin such as polyethylene and polypropylene as a single material are preferred. Polyethylene is preferred of all, and of polyethylenes, high density polyethylene, the so-called HDPE, is preferred as the material of the container. Particularly preferred polyethylene has density of from 0.951 to 0.9769 $g/cm^3$. HDPE having the density within this range and a melt index of from 0.3 to 7.0, more preferably from 0.3 to 5.0, is convenient in gas permeability and molding property. Hollow molding is convenient for molding the container for the purpose of maintaining dimensional accuracy and thickness uniformity.

A pigment which does not exert adversely influences upon an alkaline developer composition, e.g., carbon black and titanium white, calcium carbonate, and a plasticizer having the compatibility with polyethylene may be added, if necessary, to the polyethylene for use in the container of the concentrated liquid developer composition of the present invention. However, polyethylene in which the percentage of polyethylene is 85% or more and does not contain a plasticizer is preferred, and polyethylene having the percentage of polyethylene of 95% or more and not containing a plasticizer is more preferred.

The shape and the structure of the container to be filled with the concentrated liquid developer composition of the present invention can be designed arbitrarily according to the purpose. Besides the regular bottle structures, containers of a type capable of expansion and contraction as disclosed in JP-A-58-97046, JP-A-63-50839, JP-A-1-235950 and JP-A-63-45555, and containers with a flexible bulkhead as disclosed in JP-A-58-52065, JP-A-62-246061 and JP-A-62-134626 can also be used.

When the container is charged with the developer composition, it is preferred to fill the developer composition to the mouth of the container as far as possible and minimize the upper space for further heightening the safety to air oxidation, or to fill the developer composition so as to get out of contact with oxygen in the air by substituting the upper space with nitrogen, but the present invention is not limited to these filling methods.

When the developer composition according to the present invention is used in an automatic processor, the container charged with the developer composition is installed in a processor and the composition in the container is injected into a developing replenisher tank or directly into a developing tank, the inside of the container is washed with a prescribed amount of water, the water used for washing is then introduced into the replenisher tank and used as the water for preparing the replenisher, and development is performed using the thus-obtained replenisher. This is the method most effectively utilizing the advantage of the present invention. For washing the inside of the container with a prescribed amount of water, spray system washing is particularly preferred but the present invention is not limited to this method. Washing water is effectually used by this replenisher preparation method, as a result, the discharging amount of a waste solution from a developing laboratory can be reduced.

Accordingly, particularly advantageous embodiment of the present invention is the development processing system which is simple and the environmental safety and the working safety are ensured by the integration of the above-described developer composition. For example, development processing of a silver halide color photographic material is performed with an automatic processor according to the method of, e.g., installing the container charged with the developer composition in a processor, injecting the composition in the container into a developing replenisher tank, spray-washing the inside of the container and washing away the processing components adhered on the container wall, and using the water used in washing for preparing the replenisher. In this case, the setup of automatically opening the cap of the container and smoothly discharging the fluidized content when the container of the developer composition is installed in the automatic processor is provided. Further, according to the methods disclosed in JP-A-6-82988 and JP-A-8-220722, the inside of the container can be washed by spraying with washing water without necessitating hands, and the recycling of the waste container becomes easy since it can be handled cleanly. In addition, since the washing water is reused as a part of the water for dissolving the developer, there is no need to discard the water as waste solution. The concept of such a system can be realized for the first time by the developer composition embodied according to the present invention which is highly concentrated and compact content, easy to handle, whose fluidity is retained for a long period of time.

As has been described above as one embodiment of the present invention, the constitution of bottle 300 will be described in the next place with referring to FIG. 1. Bottle 300 is a container for a photographic processing agent which is suitable for use in the development processing method of a processing agent composition integration system, but the container of the composition according to the present invention is not limited to this bottle.

As shown in FIG. 1, bottle 300 has container body 302. Container body 302 is formed into a hollow box-like form by a resin material (high density polyethylene, i.e., HDPE, in the embodiment of the present invention). The upper end part of container body 302 is tapered with the diameter being gradually reduced, and forms cylindrical neck part 306 having external thread 304 threaded on the external peripheral part. The upper end part of neck part 306 is opened, and the above-described replenisher can be put in and out through this opening. On the upper end part of neck part 306 is arranged polyethylene (LDPE) sheet member 308. Thin cross slitting is provided on sheet member 308 and a contrivance is made to easily break sheet member 308 with a punching nozzle for flowing out the content of the bottle. That sheet member 308 comprises LDPE and container body 302 comprises HDPE makes the sealing property of the solution in the container securer.

Bottle 300 is provided with cap 310 as a fixed member. Cap 310 is formed to open toward neck part 306 in cylindrical form having a bottom, and internal thread 318 corresponding to external thread 304 threaded on neck part 306 is threaded on the internal peripheral part of cap 310. Cap 310 can be screwed to neck part 306, and by screwing of cap 310 to neck part 306, bottom 312 of cap 310 presses down polyethylene sheet member 308 and polyethylene sheet member 308 can be fixed to neck part 306. A circular opening 314 is formed on bottom 312 of cap 310, and polyethylene sheet member 308 can be punched in the state of putting cap 310 on.

The bottle is installed at the replenishing part in the processor upside down and the punching nozzle breaks polyethylene sheet member 308 from the lower side to inject the content of the bottle into the replenisher tank. The punching nozzle is a member serving both as a punching nozzle to punch and open the sealing part of the bottle and a water jet nozzle for washing the inner wall of the bottle after discharging the content.

The constitutional components of the developer composition according to the present invention other than the compound represented by formula (I) or (II) will be described below.

A developer composition is an alkaline continuous phase liquid containing constitutional components contained in a general color developer in a dissolved state. A color developing agent is contained therein, and preferred examples are well-known aromatic primary amine color developing agents, in particular, p-phenylenediamine derivatives. Representative examples of p-phenylenediamine derivatives are shown below, but the present invention is not limited thereto.

Recently, among the black and white light-sensitive materials, sometimes, the coupler is added to form black color, and then black and white image is formed using the general use-color developing solution. Accordingly, the color developing solution of the present invention is also applied to processing of such a light-sensitive materials.

1) N,N-Diethyl-p-phenylenediamine
2) 4-Amino-3-methyl-N,N-diethylaniline
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)aniline
7) 4-Amino-3-methyl-N-ethyl-N-(4-hydroxybutyl)aniline
8) 4-Amino-3-methyl-N-ethyl-N-(β-methanesulfonamidoethyl)aniline
9) 4-Amino-N,N-diethyl-3-(β-hydroxyethyl)aniline
10) 4-Amino-3-methyl-N-ethyl-N-(β-methoxyethyl)aniline
11) 4-Amino-3-methyl-N-(β-ethoxyethyl)-N-ethylaniline
12) 4-Amino-3-methyl-N-(3-carbamoylpropyl)-N-n-propylaniline
13) 4-Amino-3-methyl-N-(4-carbamoylbutyl)-N-n-propylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Of the above p-phenylenediamine derivatives, preferred are Compounds 5), 6), 7), 8) and 12), and Compounds 5) and 8) are particularly preferred. These p-phenylenediamine derivatives are generally in the form of salts such as sulfate, hydrochloride, sulfite, naphthalenedisulfonate, p-toluenesulfonate when they are in the state of solid materials These processing agent compositions are mixed with water in the prescribed ratio and used as the working solution of a developing replenisher (or a further diluted developing solution). The concentration of the aromatic primary amine color developing agent in the working solution is preferably from 2 to 200 mmol, more preferably from 12 to 200 mmol, and still more preferably from 12 to 150 mmol, per liter of the developing solution.

It is preferred for the liquid development processing agent according to the present invention to further contain polyethylene glycol, ethyleneureas and polyvinyl pyrrolidones. By using these compounds in combination with the compound represented by formula (I) and/or the compound represented by formula (II), in particular, with the compound represented by formula (II), air oxidation resistance of the concentrated liquid development processing agent and the coloring of the container and the processing agent composition are improved, and the color balance at rapid development is particularly improved.

As polyethylene glycols, diethylene glycol, triethylene glycol, and polyethylene glycol (average molecular weight: 200, 300, 400, 600, 1,000, 1,540, 2,000, 4,000, 6,000, 20,000) can be exemplified, preferably diethylene glycol, triethylene glycol, and polyethylene glycol (average molecular weight: from 1,000, to 2,000) can be exemplified.

The following compounds can be exemplified as the examples of ethyleneureas. Of these compounds, Compound (E-11) is preferred.

E-1

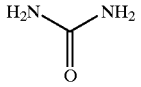

-continued

E-2

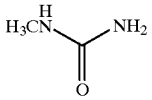

E-3

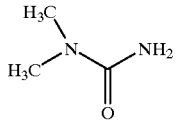

E-4

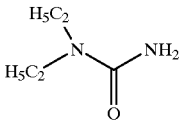

E-5

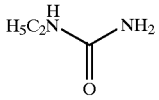

E-6

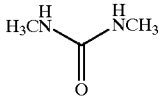

E-7

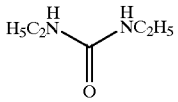

E-8

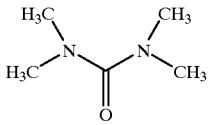

E-9

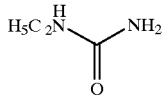

E-10

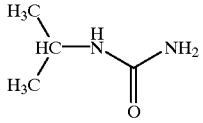

E-11

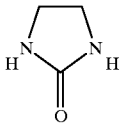

E-12

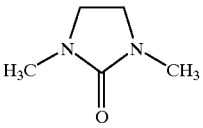

E-13

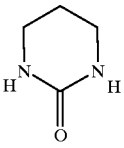

-continued

E-14

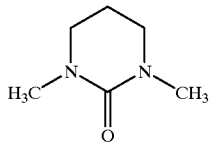

E-15

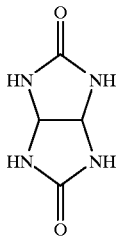

E-16

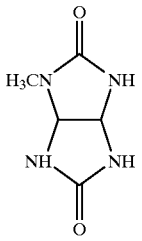

E-17

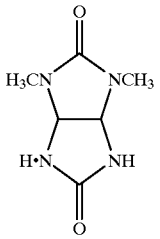

E-18

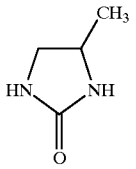

E-19

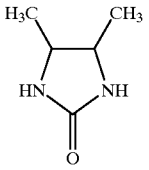

E-20

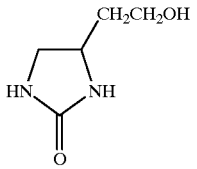

E-21

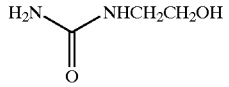

-continued

E-22

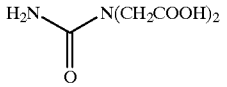

E-23

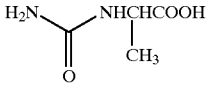

E-24

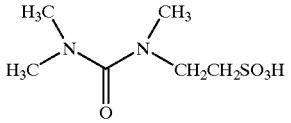

As polyvinyl pyrrolidones, poly-N-vinyl-2-pyrrolidone and poly-N-vinyl-2-pyrrolidone/vinyl alcohol can be exemplified.

Combinations of compound represented by formula (I) and/or formula (II), diethylene glycol, triethylene glycol, and/or polyethylene glycol (average molecular weight: from 1,000, to 2,000), and poly-N-vinyl-2-pyrrolidone are more preferably used. Of these, it is preferred to use the compound represented by formula (II).

The contents of ethylene glycol, ethyleneureas and polyvinyl pyrrolidones are not particularly limited but the content of each of them is from 0.1 to 100 g, preferably from 1 to 50 g, and more preferably from 5 to 20 g.

The processing agent composition of the present invention contains a small amount of sulfite ion in some cases according to the objective photographic material, or does not substantially contain in other cases. This is because a sulfite ion sometimes adversely affects photographic characteristics during color developing process according to the objective photographic materials, although it has conspicuous preservative property.

Hydroxylamine is also contained in the constitutional component of the composition or not contained according to the kind of materials to be used, because hydroxylamine sometimes affects photographic characteristics since it has silver development activity concurrently with the function as the preservative of a developing solution.

It is preferred for the concentrated processing agent composition according to the present invention to contain inorganic preservatives such as the above hydroxylamine and a sulfite ion and organic preservatives. Organic preservatives used herein means organic compounds at large which reduce the deterioration speed of the aromatic primary amine color developing agent when added to the processing solution of a photographic material. That is, organic preservatives herein means organic compounds which have functions to prevent the air oxidation of color developing agents and, above all, hydroxylamine derivatives, hydroxamic acids, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines are particularly effective organic preservatives. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. No. 3,615,503, 2,494,903, JP-A-52-143020, and JP-B-48-30496 (the term "JP-B" as used herein means an "examined Japanese patent publication").

In addition, the various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349, and the aromatic polyhydroxyl compounds disclosed in U.S. Pat. No. 3,746,544 may be used as preservatives, if necessary. The addition of alkanolamines other than the alkanolamines described above, e.g., triethanolamine and triisopropanolamine, substituted or unsubstituted dialkylhydroxylamine such as disulfoethylhydroxylamine and diethylhydroxylamine, or aromatic polyhydroxyl compounds is particularly preferred.

Of the above organic preservatives, hydroxylamine derivatives are particularly preferably used, and details thereof are disclosed in JP-A-1-97953, JP-A-1-186939, JP-A-1-186940, and JP-A-1-187557. The combined use of hydroxylamine derivatives with amines is particularly preferred from the point of the improvement of stability of the color developing solution and the improvement of stability at continuous processing.

As the above-described amines, the cyclic amines as disclosed in JP-A-63-239447, the amines as disclosed in JP-A-63-128340, and the amines as disclosed in JP-A-1-186939 and JP-A-1-187557 can be exemplified.

Chlorine ions may be added to the concentrated processing agent composition according to the present invention, if necessary. In many cases, a color developing solution (in particular, a color developing solution for color print materials) generally contains chlorine ions in an amount of from $3.5\times10^{-2}$ to $1.5\times10^{-1}$ mol/liter, but since chlorine ions are generally released into a developing solution as a by-product of development, the addition to a replenisher is not necessary in many cases. The amount of the chlorine ion in a replenisher, i.e. , in the original processing agent composition, is set up so that the chlorine ion concentration in a developing tank of the time when reached running equilibrium composition becomes the above-described level of concentration. In many developing solutions for photographic materials for printing, when the concentration of the chlorine ion is more than $1.5\times10^{-1}$ mol/liter, the development is delayed, which is disadvantageous as rapid development property and color density are impaired. If the concentration is less than $3.5\times10^{-2}$ mol/liter, it is not preferred in many cases for preventing fog. Since many silver halide photographic materials for photographing generally substantially do not contain silver chloride, the control of chlorine ion concentration at development processing is not necessary and the processing agent compositions used do not generally contain chlorine ions as the constitutional component.

With respect to the processing agent composition, since similarly to the chlorine ion, bromine ions are also dissolved out from a photographic material into a processing solution and accumulated, the concentration of bromine ions is controlled so as to maintain equilibrium concentration. The concentration of bromine ions in a color developing solution is preferably from 1 to $5\times10^{-3}$ mol/liter or so for materials for photographing and $1.0\times10^{-3}$ mol/liter or less for materials for printing. Bromine ions may be added to the processing agent composition according to necessity so as to reach the above bromine ion concentration range.

Iodine ions are dissolved out from color photographic materials for photographing into a developing solution but photographic materials for printing generally do not contain silver iodide. The concentration of iodine ions in a developing solution is from $5\times10^{-5}$ mol/liter to $5\times10^{-4}$ mol/liter or so, and, if necessary, iodine ions may be added to the processing agent composition for maintaining the concentration.

When halide ions are added to the processing agent composition, s odium chloride, potassium chloride, ammonium chloride, lithium chloride, nickel chloride, magnesium chloride, manganese chloride, and calcium chloride can be exemplified as chlorine ion supplying substances. Sodium chloride and potassium chloride are preferred of these.

As bromine ion supplying substances, sodium bromide, potassium bromide, ammonium bromide, lithium bromide, calcium bromide, magnesium bromide, manganese bromide, nickel bromide, cerium bromide, and thallium bromide can be exemplified. Potassium bromide and sodium bromide are preferred of these.

As iodine ion supplying substances, sodium iodide, potassium iodide, lithium iodide, calcium iodide, magnesium iodide and thallium iodide can be exemplified. Potassium iodide and sodium iodide are preferred of these.

When the photographic material to be processed is color paper, since it is an important picture quality that the white background of the picture plane is white, it is important to finish the color paper white in appearance with a brightening agent. Brightening agents are added to a photographic material according to their properties but a method of permeating a photographic material from a processing solution in development processing may be used. In such a case, for the purpose of obtaining a high whitening effect, an appropriate object addition processing solution is selected according to the properties of the brightening agents. Therefore, there are cases when brightening agents are added to color developing solutions having a high pH value.

In many cases stilbene-based brightening agents are used, in particular, di(triazinylamino)stilbene-based and 4,4'-diamino-2,2'-disulfostilbene-based brightening agents are preferably used.

Particularly preferred stilbene-based brightening agent is 4,4'-ditriazinylamino-2,2'-disulfostilbene but the present invention is not limited to this compound.

Conventionally well-known easily available stilbene-based brightening agents can be used in the present invention, or they can be easily synthesized according to well-known methods.

The stilbene-based brightening agents may be added to a desilvering solution or a photographic material as well as a color developing solution, and when added to a color developing solution, the concentration is preferably from $1\times10^{-4}$ to $5\times10^{-2}$ mol/liter, more preferably from $2\times10^{-4}$ to $1\times10^{-2}$ mol/liter. The addition amount of the composition of the processing agent of the present invention is determined so that the working developing solution contains a brightening agent in this concentration.

The concentrated liquid processing agent composition according to the present invention itself has pH of from 9.5 to 13.0, but the color developing solution prepared therefrom has pH of from 9.0 to 12.2, more preferably from 9.9 to 11.2, and other well-known developing solution components can be added.

Various alkali agents and buffers are preferably used for maintaining the above pH level. Examples of alkali agents and buffers which can be used include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and lysine salt. Carbonate, phosphate, tetraborate and hydroxybenzoate are particularly excellent in buffering ability in a high pH range of pH 9.0 or more, and do not adversely affect photographic properties (such as causing fogging) when added to a color developing solution and inexpensive, therefore, the use of these buffers is particularly preferred. Buffers are added to the composition in concentration of from 0.01 to 2 mol, preferably from 0.1 to 0.5 mol, per mol of the developing replenisher. Alkali agents are added to adjust the pH of the developing solutions in which buffers are contained to a prescribed value.

Specific examples of these alkali agents and buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), sodium hydroxide, potassium hydroxide, and lithium hydroxide. However, the present invention is not limited to these compounds.

The above buffers are added to the color developing replenisher prepared by dilution in an amount of preferably 0.1 mol/liter or more, and particularly preferably from 0.1 mol/liter to 0.4 mol/liter.

In the present invention, potassium hydroxide is preferably used as an alkali agent in addition to potassium carbonate, in particular it is preferred to use potassium hydroxide by substituting a part of potassium hydroxide with lithium hydroxide, which further improves the precipitation preventing effect of a developing kit.

Various chelating agents, which are precipitation preventing agents of other components of color developing solution, e.g., calcium and magnesium, or stability improving agents of the color developing solution can be used in the processing agent composition of the present invention. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, ethylenediaminesuccinic acid (SS body), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid.

These chelating agents may be used in combination of two or more of them, if required.

The addition amount of these chelating agents should be sufficient to enclose metal ions in a color developing solution, and the amount is, for example, about 0.1 g to 10 g per liter of a color developing solution.

The processing agent composition according to the present invention can contain a development accelerator, if desired.

For example, the thioether-based compounds disclosed in JP-B-37-16088, JP-B-37-5987, JP-B-38-7826, JP-B-44-12380, JP-B-45-9015 and U.S. Pat. No. 3,813,247, the p-phenylenediamine-based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine-based compounds disclosed in U.S. Pat. No. 2,494,903, 3,128,182, 4,230,796, 3,253,919, JP-B-41-11431, U.S. Pat. No. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary.

An arbitrary antifoggant can be added to the processing agent composition according to the present invention, if desired. Alkali metal halides such as sodium chloride, potassium bromide and potassium iodide, and organic antifoggants can be used as an antifoggant. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine. When organic antifoggants are used, the addition amount is set up so that the concentration of antifoggants in 1 liter of the developing solution or developing replenisher prepared from the processing agent composition falls the within the range of from 0.05 to 5 mmol.

Besides the surfactants according to the present invention, various surfactants can be used if required, e.g., alkylsulfonic acid, arylsulfonic acid, aliphatic carboxylic acid, and aromatic carboxylic acid can be used.

The color developer composition and the color developing replenisher or the color developing solution prepared therefrom for use in the present invention are as described above.

When the photographic material to be processed is a color print material, the color development processing temperature applied to the present invention is from 30 to 55° C., preferably from 35 to 55° C., and more preferably from 40 to 55° C. The development processing time is from 5 to 90 seconds, preferably from 15 to 60 seconds. The replenishing rate is preferably less, but is generally appropriately from 20 to 600 ml, preferably from 30 to 120 ml, and particularly preferably from 15 to 60 ml, per $m^2$ of the photographic material.

On the other hand, when the photographic material is a color negative film or a color reversal film, the development processing temperature is from 30 to 55° C., preferably from 35 to 55° C., and more preferably from 40 to 55° C., and the development processing time is from 20 seconds to 6 minutes, preferably from 30 to 200 seconds, and more preferably from 60 to 150 seconds. In particular, from 1 to 4 minutes is preferred with the case of a color negative film. The replenishing rate is preferably less, but is generally appropriately from 20 to 1,000 ml, preferably from 50 to 600 ml, and particularly preferably from 100 to 400 ml, per $m^2$ of the photographic material. When the concentrated replenisher composition and water are separately added to a developing solution, the replenishing rate is the total of the replenisher composition and water.

The present invention is preferably applied to color negative processing.

The developer composition according to the present invention is prepared according to some methods. The following three methods bring about good results. However, it should not be construed as the present invention is limited to the following three methods.

Method A

A small amount of water is introduced to a mixing tank in advance, and the constitutional compounds are successively added thereto with stirring.

Method B

The powders of the constitutional compounds are mixed in advance, and the mixture is added into a small amount of water in a mixing tank at a stretch.

Method C

The constitutional compounds are in advance divided to two or more groups comprising those which can be combined previously, and each group is dissolved in water or a hydrophilic mixed solvent to make a concentrated solution, and these concentrated solutions are mixed.

Producing methods partially combining each of these groups may be used.

In the present invention, the development step by a color developing solution prepared from the developer composition of the present invention is followed by the desilvering step, where the processing with a bleaching solution and a blixing solution is performed. When the photographic material is a color print material, the processing solution may also contain the above-described appropriate brightening agents, preferably stilbene-based brightening agents.

As the bleaching agents for use in a bleaching or blixing solution, well-known bleaching agents can be used, in particular, organic complex salts of iron (III) (e. g., complex salts of aminopolycarboxylic acids), or organic acids such as citric acid, tartaric acid, and malic acid, persulfate, and hydrogen peroxide are preferably used.

Of these compounds, organic complex salts of iron (III) are particularly preferred from the viewpoint of rapid processing and environmental protection. Examples of aminopolycarboxylic acids and salts thereof useful for forming organic complex salts of iron(III) include biodegradable ethylenediaminedisuccinic acid (SS body), N-(2-carboxylatoethyl)-L-aspartic acid, β-alaninediacetic acid, methyliminodiacetic acid, in addition, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, and glycol ether diaminetetraacetic acid. These compounds maybe any form of sodium salts, potassium salts, lithium salts and ammonium salts. Of these compounds, ethylenediaminedisuccinic acid (SS body), N-(2-carboxylatoethyl)-L-aspartic acid, β-alaninediacetic acid, ethylene-diaminetetraacetic acid, 1,3-diaminopropanetetraacetic acid, and methyliminodiacetic acid are preferred because iron (III) complex salts thereof are excellent in photographic characteristics. (In the above compounds, that described as "SS body" is a compound having two asymmetric carbon atoms and each of two has SS type absolute configuration.) These ferric ion complex salts may be used in the form of complex salt, or ferric ion complex salts may be formed in a solution using ferric salts, e.g., ferric sulfate, ferric chloride, ferric nitrate, ferric ammonium sulfate and ferric phosphate with a chelating agent such as aminopolycarboxylic acid. A chelating agent may be used in the excess amount more than the amount for forming ferric ion complex salt. Of the iron complexes, aminopolycarboxylic acid iron complex is preferred, and the addition amount thereof is from 0.01 to 1.0 mol/liter, preferably from 0.05 to 0.50 mol/liter, still more preferably from 0.10 to 0.50 mol/liter, and most preferably from 0.15 to 0.40 mol/liter.

The bleaching time is generally from 30 seconds to 6 minutes and 30 seconds, preferably from 1 minute to 4 minutes and 30 seconds, and the bleaching time of a color print material is from 30 seconds to 2 minutes.

It is preferred that a bleaching solution, a blixing solution or a fixing solution contain various well-known organic acids (e. g. , glycolic acid, succinic acid, maleic acid, malonic acid, citric acid, sulfosuccinic acid), organic bases (e.g., imidazole, dimethylimidazole), or a compound represented by formula (A-a) disclosed in JP-A-9-211819 such as 2-picolic acid, and a compound represented by formula (B-b) disclosed in JP-A-9-211819 such as kojic acid. The addition amount of these compounds is preferably from 0.005 to 3.0 mol, more preferably from 0. 05 to 1.5 mol, per liter of a processing solution.

Various well-known fixing agents are used in the blixing solution or the fixing solution of the present invention. Examples thereof include thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and water-soluble silver halide solvents (i.e., solubilizing agent) such as thioureas. These compounds can be used alone or in combination of two or more. Further, the specific blixing solution comprising combination of a fixing agent and halides such as a great amount of potassium iodide as disclosed in JP-A-55-155354 can also be used in the present invention. Thiosulfate, in particular, ammonium thiosulfate, is particularly preferably used in the present invention. The addition amount of a fixing agent is prefer ably from 0.3 to 2 mol, more preferably from 0.5 to 1.0 mol, per liter of the solution.

The blixing solution or the fixing solution for use in the present invention preferably has pH of from 3 to 8, more preferably from 4 to 7. When the pH is lower than this range, the solution is deteriorated and cyan dyes becomes leuco dyes accelerately, although desilvering property is improved. While when the pH is higher than this range, desilvering is delayed and stains are liable to occur.

The bleaching solution for use in the present invention has pH of 8 or less, preferably from 2 to 7, and particularly preferably from 2 to 6. When the pH is lower than this range, the solution is deteriorated and cyan dyes becomes leuco dyes accelerately, while when the pH is higher than this range, desilvering is delayed and stains are liable to occur.

For adjusting pH, if necessary, hydrochloric acid, sulfuric acid, nitric acid, bicarbonate, ammonia, potassium hydroxide, sodium hydroxide, sodium carbonate, and potassium carbonate can be added to the solution.

Further, the blixing solution of the present invention can contain other various kinds of brightening agents, defoaming agents, surfactants, and organic solvents such as polyvinyl pyrrolidone and methanol.

It is preferred that the blixing solution and the fixing solution of the present invention contain, as a preservative, sulfite ion-releasing compounds such as sulfite (e.g., sodium sulfite, potassium sulfite, ammonium sulfite, etc.), bisulfite (e.g., ammonium bisulfite, sodium bisulfite, potassium bisulfite, etc.), and metabisulfite (e. g., potassium metabisulfite, sodium metabisulfite, ammonium metabisulfite, etc.), and arylsulfinic acids such as p-toluenesulfinic acid and m-carboxybenzenesulfinic acid. The content of these compounds is preferably from about 0.02 to about 1.0 mol/liter in terms of a sulfite ion or sulfinate ion.

In addition to the above compounds, ascorbic acid, bisulfite adducts of carbonyl and carbonyl compounds can be used as a preservative.

Further, a buffer, a brightening agent, a chelating agent, a defoaming agent, and an antimold can be used, if necessary.

The blixing processing time according to the present invention is from 5 to 240 seconds, preferably from 10 to 60 seconds, and the processing temperature is from 25° C. to 60° C., preferably from 30° C. to 50° C. The replenishing rate is from 20 to 250 ml, preferably from 30 to 100 ml, and particularly preferably from 15 to 60 ml, per $m^2$ of the photographic material.

The photographic material of the present invention is generally subjected to washing step and/or stabilizing step after desilvering step such as fixing or blixing.

The amount of washing water in the washing step can be selected from a wide range according to the characteristics (e.g., by the materials used such as couplers, etc.) and the application of the photographic materials, the temperature of washing water, the number of washing tanks (the number of washing stages), and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pp. 248 to 253 (May, 1955). The number of stages in a multistage countercurrent system is generally preferably from 3 to 15, particularly preferably from 3 to 10.

According to the multistage countercurrent system, the amount of the washing water can be greatly reduced, however, problems arise that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine-based antibacterial agents such as chlorinated sodium isocyanurate as disclosed in JP-A-61-120145, the benzotriazole and copper ions as disclosed in JP-A-61-267761, and the antibacterial agents described in Hiroshi Horiguchi, *Bohkin Bohbai no Kagaku* (*Antibacterial and Antifungal Chemistry*), published by Sankyo Shuppan Co., Ltd. (1986), edited by Eisei Gijutsukai, *Biseibutsu no Mekkin, Sakkin, Bohbai Gijutsu* (*Germicidal and Antifungal Techniques of Microorganisms*), published by Kogyo Gijutsukai (1982), and edited by Nippon Bohkin Bohbai Gakkai, *Bohkin Bohbai Zai Jiten* (*Antibacterial and Antifungal Agents Thesaurus*) (1986), can be used.

According to the multistage countercurrent washing system, the amount of the washing water can be greatly reduced to the level equal to the stabilizing solution so far been used, thus this is sometimes called a water-washing substitution stabilizing solution. For stabilizing images, stabilizing solutions so far been used are also used in some cases. Accordingly, washing step is performed by combining one or more systems of a conventional water-washing system, a water-washing substitution stabilizing solution system and an image-stabilizing solution system.

Processing by the stabilizing solution follows the water-washing step or may be performed directly without being subjected to washing step. Compounds having the function of image stabilization, e.g., aldehyde compounds represented by formalin, buffers for adjusting film pH to be suitable for dye stabilization, and ammonium compounds are added to the stabilizing solution. In particular, aldehydes such as formaldehyde, acetaldehyde and pyruvic aldehyde which inactivate the residual magenta couplers and prevent the discoloration of the dyes and the generation of stains, the methylol compounds and hexamethylenetetramine disclosed in U.S. Pat. No. 4,786,583, the hexahydrotriazine disclosed in JP-A-2-153348, the bisulfite adducts of formaldehyde disclosed in U.S. Pat. No. 4,921,779, and the azolylmethylamines disclosed in EP 504609 and EP 519190 are added to the processing solution. However, any of the above washing water and stabilizing solutions has a water washing function, and they substantially the same function except that an image stabilizer is added or not added, thus they will be described collectively below.

A surfactant as a dewatering agent and a chelating agent represented by EDTA as a water softener can further be added to a stabilizing solution and washing water. Further, a brightening agent and a hardening agent can further be added to a stabilizing solution and washing water. In the process of the photographic material of the present invention, when the photographic material is directly processed with a stabilizing solution without subjecting to the washing step, any of the well-known methods disclosed in JP-A-57-8543, JP-A-58-14834 and JP-A-60-220345 can be used.

In addition, a chelating agent such as 1-hydroxyethylidene-1,1-diphosphonic acid and ethylenediaminetetramethylenephosphonic acid, and magnesium compounds and bismuth compounds are also preferably used.

The pH of the water washing step and stabilizing step is preferably from 4 to 10, more preferably from 5 to 8. The temperature can be set up according to various uses and characteristics of the photographic material but is generally from 20 to 50° C., preferably from 25 to 45° C.

Drying step is performed following washing and/or stabilizing step(s). It is possible to expedite drying by absorbing water of the material fresh from the washing tank by means of a squeegee roller and cloth from the viewpoint of reducing the carryover of water to the image film. As the improving means from the drier side, although it is a matter of course, drying can be expedited by increasing temperature and modulating the shape of blowing nozzles to strengthen the dry air. Further, as is disclosed in JP-A-3-157650, the adjustment of the angle of air blowing and discharging method of the exhaust air are also effective to speed up drying.

Photographic materials which can be used in the present invention will be described below.

As silver halides for use in the photographic material according to the present invention, silver chloride, silver bromide, silver (iodo)chlorobromide, and silver iodobromide can be used, but for the purpose of rapid processing, it is preferred to use a silver chlorobromide emulsion having a silver chloride content of 98 mol % or more which substantially does not contain silver iodide or a silver chloride emulsion. "Substantially does not contain silver iodide" means that a silver iodide content is preferably 0.1 mol % or more, more preferably 0.01 mol % or less. It is particularly preferred not to contain silver iodide at all.

Tabular grains having internal structure of silver iodobromide or non-tabular multilayer structure grains are primarily used for color photographic materials for photographing, e.g., a multilayer color negative film and a color reversal film.

It is preferred for the hydrophilic colloid layer of the photographic material of the present invention to contain a dye capable of decoloring by processing (especially oxonol dyes), disclosed in EP-A-337490, pp. 27 to 76, so as to make the optical reflection density at 680 nm of the photographic material become 0.70 or more, or for the water resistant resin layer of the support to contain 12 wt % or more (more preferably 14 wt % or more) of a titanium oxide surface treated with divalent to tetravalent alcohols (for example, trimethylolethane or the like), for the purpose of improving sharpness of images.

It is preferred for the photographic material for use in the present invention to contain bactericides as disclosed in JP-A-63-271247 to prevent propagation of various mold and bacteria in a hydrophilic colloid layer which deteriorate images.

As the support for use for the photographic material according to the present invention, cellulose triacetate, poly (ethylene terephthalate), and poly (ethylene naphthalate) are used for photographic materials for photographing, and paper laminated with polyethylene to which a white pigment is mixed (resin-coated paper) and a poly (ethylene terephthalate) film for display to which a white pigment is mixed are used for color print materials.

The photographic material of the present invention may be exposed with either visible light or infrared light. An exposure may be either of a low intensity exposure or a high intensity short time exposure, and in the latter case, a laser scanning exposure whose exposure time per one pixel is shorter than $10^{-4}$ seconds is preferred.

With respect to silver halide emulsions and other materials (e.g., additives, etc.) to be applied to the photographic material according to the present invention, photographic constitutional layers (layer arrangement, etc.) and the processing methods and processing additives for processing the photographic material, those disclosed in EP-A-0355660, JP-A-2-33144 and JP-A-62-215272, and those listed in the following Table 1 are preferably used.

TABLE 1

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | | page 648, right column | |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbers, Filter Dyes, and Ultraviolet Absorbers | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | | | pages 878–879 |

Cyan couplers disclosed in JP-A-2-33144, EP-A-0333185 and JP-A-64-32260 can also be used in the present invention.

It is preferred that cyan, magenta and yellow couplers are emulsification-dispersed in a hydrophilic colloidal aqueous solution by impregnating with a loadable latex polymer (e.g., disclosed in U.S. Pat. No. 4,203,716) in the presence (or absence) of high boiling point organic solvents described in the above Table 1, or by dissolving with a water-insoluble but organic solvent-soluble polymer.

As preferred water-insoluble but organic solvent-soluble polymers, the homopolymers or copolymers disclosed in U.S. Pat. No. 4,857,449, from 7th column to 15th column, or WO 88/00723, from pages 12 to 30 can be exemplified. In particular, methacrylate-based or acrylamide-based polymers are preferred in view of the color image stability.

It is preferred to use the color image stability-improving compounds disclosed in EP-A-0277589 in combination with pyrazoloazole couplers, pyrrolotriazole couplers, or acylacetamide yellow couplers in the photographic material according to the present invention.

As cyan couplers, in addition to the phenol couplers and the naphthol couplers described in known literature listed in the above table, the cyan couplers disclosed in JP-A-2-33144, EP-A-0333185, JP-A-64-32260, EP-A-0456226, EP 0484909, EP 0488248 and EP-A-0491197 are preferably used.

In addition to the 5-pyrazolone magenta couplers described in known literature listed in the above table, magenta couplers disclosed in WO 92/18901, WO 92/18902 and WO/18903 are also preferably used in the present invention. Besides these 5-pyrazolone magenta couplers, well-known pyrazoloazole couplers can be used in the present invention. The pyrazoloazole couplers disclosed in JP-A-61-65245, JP-A-61-65246, JP-A-61-14254, EP-A-226849, and EP-A-294785 are preferably used above all in the point of hue, image stability and coloring property.

As yellow couplers, well-known acylacetanilide couplers are preferably used, and couplers disclosed in EP-A-0447969, JP-A-5-107701, JP-A-5-113642, EP-A-0482552, and EP-A-0524540 are particularly preferably used.

As couplers the colored dyes of which have an appropriate diffusibility, the couplers disclosed in U.S. Pat. No. 4,366,237, British Patent 2,125,570, EP-B-96873 and German Patent 3,234,533 are preferred. As couplers for correcting the unnecessary absorption of colored dyes, the yellow colored cyan couplers represented by formula (CI), (CII), (CIII) or (CIV) disclosed on page 5 of EP-A-456257 (in particular, compound YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the exemplified compounds on pages 36 to 45).

As compounds (inclusive of couplers) which release photographically useful residual groups of compounds upon reacting with the oxidation product of a developing agent, the following compounds can be exemplified:

Development inhibitor releasing compounds:

the compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (1) disclosed in EP-A-568037 (in particular, compound (23) (page 11)); and the compounds represented by formula (I), (II) or (III) disclosed on pages 5 and 6 of EP-A-440195 (in particular, I-(1) on page 29);

Bleaching accelerator releasing compounds:

the compounds represented by formula (I) or (I') disclosed on page 5 of EP-A-310125 (in particular, compound (60) and compound (61) on page 61); and the compounds represented by formula (I) disclosed in claim 1 of JP-A-6-59411 (in particular, compound (7) on page 7);

Ligand releasing compounds:

the compounds represented by LIG-X disclosed in claim 1 of U.S. Pat. No. 4,555,478 (in particular, the compounds in lines 21 to 41, column 12);

Leuco dye releasing compounds:

compounds 1 to 6, columns 3 to 8 of U.S. Pat. No. 4,749,641;

Fluorescent dye releasing compounds:

the compounds represented by COUP-DYE disclosed in claim 1 of U.S. Pat. No. 4,774,181 (in particular, compounds 1 to 11, columns 7 to 10);

Development accelerator-releasing or fogging agent-releasing compounds:

the compounds represented by formula (1), (2) or (3), column 3 of U.S. Pat. No. 4,656,123 (in particular, compound (I-22), column 25); and compound ExZK-2, lines 36 to 38, page 75 of EP-A-450637; and Compounds which release dyes the color of which is restored after elimination:

the compounds represented by formula (I) disclosed in claim 1 of U.S. Pat. No. 4,857,447 (in particular, Y-1 to Y-19, columns 25 to 36).

Preferred additives other than couplers are listed below:

Dispersion mediums of oil-soluble organic compound:

Compounds P-3, P-5, P-16, P-19, P-25, P-30, P-42, P-49, P-54, P-55, P-66, P-81, P-85, P-86 and P-93 (pages 140 to 144) of JP-A-62-215272;

Latexes for impregnation of oil-soluble organic compound:

the latexes disclosed in U.S. Pat. No. 4,199,363;

Scavengers for the oxidation product of a developing agent:

the compounds represented by formula (I), lines 54 to 62, column 2 of U.S. Pat. No. 4,978,606 (in particular, I-(1), I-(2), I-(6) and I-(12), columns 4 and 5); and the compounds represented by the formula disclosed in lines 5 to 10, column 2 of U.S. Pat. No. 4,923,787 (in particular, compound 1, column 3);

Stain inhibitors:

the compounds represented by formula (I), (II) or (III), lines 30 to 33, page 4 of EP-A-298321 (in particular, I-47, I-72, III-1 and III-27, pages 24 to 48);

Discoloration inhibitors:

Compounds A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321; Compounds II-1 to III-23, columns 25 to 38 of U.S. Pat. No. 5,122,444 (in particular, III-10); I-1 to III-4, pages 8 to 12 of EP-A-471347 (in particular, II-2); and A-1 to A-48, columns 32 to 40 of U.S. Pat. No. 5,139,931 (in particular, A-39 and A-42);

Compounds for reducing the using amounts of color intensifiers and color mixing preventives:

Compounds I-1 to II-15, pages 5 to 24 of EP-A-411324 (in particular, I-46);

Formaldehyde scavengers:

Compounds SCV-1 to SCV-28, pages 24 to 29 of EP-A-477932 (in particular, SCV-8);

Hardening agents:

Compounds H-1, H-4, H-6, H-8 and H-14 on page 17 of JP-A-1-214845; the compounds represented by any of formulae (VII) to (XII), columns 13 to 23 of U.S. Pat. No. 4,618,573 (H-1 to H-54); the compounds represented by formula (6), right lower column, page 8 of JP-A-2-214852 (H-1 to H-76) (in particular, H-14); and the compounds disclosed in claim 1 of U.S. Pat. No. 3,325,287;

Development inhibitor precursors:

Compounds P-24, P-37 and P-39, pages 6 and 7 of JP-A-62-168139; and the compounds disclosed in claim 1 of U.S. Pat. No. 5,019,492 (in particular, compounds 28 and 29, column 7);

Fungicides and biocides:

Compounds I-1 to III-43, columns 3 to 15 of U.S. Pat. No. 4,923,790 (in particular, II-1, II-9, II-10, II-18 and III-25);

Stabilizers and antifoggants:

Compounds I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical sensitizers:

triphenylphosphine selenide; and compound 50 disclosed in JP-A-5-40324;

Dyes (i.e., Dyestuffs):

Compounds a-i to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124, pages 8 to 26 of WO 88/04794; compounds 1 to 22, pages 6 to 11 of EP-A-319999 (in particular, compound 1); compounds D-1 to D-87 represented by any of formulae (1) to (3), pages 3 to 28 of EP-A-519306; compounds 1 to 22 represented by formula (I), columns 3 to 10 of U.S. Pat. No. 4,268,622; and compounds (1) to (31) represented by formula (I), columns 2 to 9 of U.S. Pat. No. 4,923,788;

Ultraviolet absorbers:

Compounds (18b) to (18r) represented by formula (1), 101 to 427, pages 6 to 9 of JP-A-46-3335; Compounds (3) to (66) represented by formula (I), pages 10 to 44, and Compounds HBT-1 to HBT-10 represented by formula (III), page 14, of EP-A-520938; and Compounds (1) to (31) represented by formula (1), columns 2 to 9 of EP-A-521823.

The present invention can be applied to color negative films for general and cinematographic uses. The present invention can also preferably be applied to the film units equipped with lenses as disclosed in JP-B-2-32615 and JP-B-U-3-39784 (the term "JP-B-U" as used herein means an "examined Japanese utility model publication"). Suitable supports which can be used in the present invention are disclosed, for example, in RD, No. 17643, page 28, RD, No. 18716, from page 647, right column to page 648, left column, and RD, No. 307105, page 879. Preferred supports are polyester supports.

It is preferred that the color negative film for use in the present invention has a magnetic recording layer. The magnetic recording layer for use in the present invention will be explained below. The magnetic recording layer for use in the present invention is a layer coated on a support with an aqueous or organic solvent based coating solution comprising magnetic particles dispersed in a binder. Examples of the magnetic particles for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chromium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the magnetic particle may be any of an acicular shape, an ellipsoidal shape, a spherical shape, a cubic shape, or a plate-like shape. The specific surface area ($S_{BET}$) is preferably 20 $m^2/g$ or more, and particularly preferably 30 $m^2/g$ or more.

The binders which can be used for the magnetic particles includes thermoplastic resins, thermosetting resins, radiation curable resins, reactive type resins, acid-, alkali- or biodegradable polymers, natural polymers (e.g., cellulose derivatives, saccharide derivatives), and mixtures thereof as disclosed in JP-A-4-219569. The above described resins have a Tg of from −40° C. to 300° C., and a weight average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylate resins, and polyvinyl acetal resins. Gelatin is also preferably used. Cellulose di (tri) acetate is particularly preferred. The binder can be subjected to curing treatment by adding epoxy-based, aziridine-based or isocyanate-based crosslinking agent. Examples of the isocyanate-based crosslinking agents include isocyanates such as tolylenediisocyanate, 4,4'-diphenylmethanediisocyanate, hexamethylenediisocyanate and xylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed in JP-A-6-59357.

A magnetic recording layer may be provided with functions of lubrication improvement, curling adjustment, antistatic property, adhesion prevention and head abrasion, or another functional layer having these functions may be provided, and at least one kind or more of the particles are preferably abrasives of aspheric inorganic particles having Mohs' hardness of 5 or more. The composition of the aspheric inorganic particle is preferably an oxide such as aluminum oxide, chromium oxide, silicon dioxide, titanium dioxide, etc., a carbide such as silicon carbide and titanium carbide, and fine particles such as diamond. The surface of these abrasives may be treated with a silane coupling agent or a titanium coupling agent. These particles may be added to a magnetic recording layer, or may be overcoated on a magnetic recording layer (e.g., a protective layer, a lubricating layer). The above described binders can be used at this time, preferably the same binders as the binder of the magnetic recording layer are used. Photographic materials having magnetic recording layers are disclosed in U.S. Pat. No. 5,336,589, 5,250,404, 5,229,259, 5,215,874 and EP 466130.

The polyester support for use in the present invention will be described below, but details including photographic materials other than described above, processing, cartridges and working examples are disclosed in Kokai-Giho, Kogi No. 94-6023 (Hatsumei-Kyokai, March 15, 1994). The polyester for use in the present invention comprises diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols, diethylene glycol, triethylene glycol, cyclohexanedimethanol, bisphenol A, and bisphenol can be eexemplified. Polymerized polymers thereof include homopolymers such as polyethylene terephthalate, polyethylene naphthalate, polycyclohexanedimethanol terephthalate and the like. Particularly preferred is polyester comprising from 50 mol % to 100 mol % of 2,6-naphthalenedicarboxylic acid. Particularly preferred above all is polyethylene 2,6-naphthalate The average molecular weight of them is about 5,000 to 200,000. Tg of the polyester for use in the present invention is 50° C. or more, and 90° C. or more is preferred.

To ensure adhesion of the support and the constitutional layers of the photographic material, the surface activation treatment is preferably carried out, such as a chemical treatment, a mechanical treatment, a corona discharge treatment, a flame treatment, an ultraviolet treatment, a high frequency treatment, a glow discharge treatment, an active plasma treatment, a laser treatment, a mixed acid treatment, and an ozone oxidation treatment, and preferred of them are an ultraviolet irradiation treatment, a flame treatment, a corona discharge treatment, and a glow discharge treatment. An undercoating method is described below. An undercoat layer may be a single layer or may comprise two or more layers.

The binder for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (chrome alum), aldehydes (formaldehyde, glutaraldehyde), isocyanates, active halide compounds (2,4-dichloro-6-hydroxy-S-triazine), epichlorohydrin resins, and active vinyl sulfone compounds. $SiO_2$, $TiO_2$, inorganic fine particles or polymethyl methacrylate copolymer fine particles (0.01 to 10 $\mu$m) may be contained as a matting agent.

The photographic material of the present invention preferably contains a matting agent. The matting agent may be added to either of the emulsion layer side or the backing layer side but it is particularly preferably to be added to the outermost layer on the emulsion layer side. The matting agent may be either soluble or insoluble in a processing solution, preferably both types are used in combination. For example, polymethyl methacrylate, poly(methyl methacrylate/methacrylic acid=9/1 or 5/5 (mol ratio)), and polystyrene particles are preferably used. The average particle size is preferably from 0.8 to 10 $\mu$m, and particle size distribution is preferably narrower, preferably 90% or more of the entire particle number accounts for 0.9 to 1.1 times of the average particle size. For increasing the matting property, fine particles having a particle size of 0.8 $\mu$m or less are preferably added at the same time. For example, polymethyl methacrylate (0.2 $\mu$m), poly(methyl methacrylate/methacrylic acid=9/1 (mol ratio), 0.3 $\mu$m), polystyreneparticles (0.25 $\mu$m), and colloidal silica (0.03 $\mu$m) are enumerated.

The photographic material of the present invention has a total film thickness of all the hydrophilic colloid layers on the side where the emulsion layers are located of preferably 28 $\mu$m or less, more preferably 23 $\mu$m or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under conditions of 25° C., 55% relative humidity (stored for two days), and $T_{1/2}$ can be measured using a swellometer of the type described in A. Green et al., *Photogr. Sci. Eng.*, Vol. 19, No. 2, pages 124 to 129. $T_{1/2}$ can be adjusted by adding hardening agents to gelatin which is used as a binder, or by changing the storage conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness. It is preferred to provide hydrophilic colloidal layers (called backing layers) on the photographic material of the present invention on the side of the support opposite to the side on which emulsion layers are provided having a total dry film thickness of from 2 μm to 20 μm. The inclusion of the above-described light absorbers, filter dyes, ultraviolet absorbers, antistatic agents, hardening agents, binders, plasticizers, lubricants, coating aids, and surfactants in backing layers is preferred. The swelling factor of backing layers is preferably from 150 to 500%.

EXAMPLE

The present invention is specifically described below with referring to examples, but it should not be construed as the present invention is limited thereto.

Example 1

Stability to Precipitation

A color developer composition having the following composition was prepared for examining the stability to precipitation.

| Color Developer Composition | |
|---|---|
| Diethylenetriaminepentaacetic Acid | 6.0 g |
| Sodium 4,5-Dihydroxybenzene-1,3-disulfonate | 1.0 g |

-continued

| Color Developer Composition | |
|---|---|
| Sodium Sulfite | 15.0 g |
| Potassium Carbonate | 100.0 g |
| Compound Shown in Table 1 | (see Table 1) |
| Disodium-N,N-bis(sulfonatoethyl) -hydroxylamine | 24.0 g |
| 4-Amino-3-methyl-N-ethyl-N-(β-hydroxyethyl)aniline Sulfate | 20.0 g |
| Water to make | 1.0 liter |
| pH (adjusted with potassium hydroxide) | 11.0 |

The color developer composition prepared was put in a glass bottle and stored at −5° C. for 4 weeks. The state of the liquid was visually observed and evaluated by five stage rankings of ◎: precipitation was not generated, ○: thin turbidity was generated, Δ: precipitation was generated a little, ×: clear precipitation was generated, and ××: conspicuous precipitation was extremely generated. The results obtained are shown in Table A.

Comparative Sample Nos. 2 to 11 in which conventionally well-known compounds were used did not show the effect of precipitation prevention, or a little even if effective, as compared with Comparative Sample No. 1 containing no precipitation preventing agent, while in any of Sample Nos. 13 to 24 of the present invention to which the compound of the present invention was added, precipitation was not observed, or little even if precipitation occurred, and the precipitation preventing effect equal to or more than the precipitation preventing agent disclosed in JP-A-11-174643 (ethyleneurea in Sample No. 12) was observed.

Example 2

Storage Stability with Aging

The concentrated developer composition prepared in Example 1 was poured into polyethylene (HDPE) bottles to the mouth and sealed, and bottles were stored at 40° C. and 50° C. respectively for 8 weeks. The state of the liquid of each bottle stored with heating was visually observed and evaluated by five stage rankings of ◎: neither the bottle nor the developer composition was colored, ○: thin coloring was observed on the composition, Δ: coloring was observed a little on the bottle, ×: the bottle was clearly colored, and ××: the bottle was conspicuously colored. The results obtained are also shown in Table A.

TABLE A

| Sample No. | Compound Added | Addition Amount (g/l) | Precipitation | Heating 40° C. | Heating 50° C. | Remarks |
|---|---|---|---|---|---|---|
| 1 | None | — | xx | xx | xx | Comp. |
| 2 | Sodium p-toluenesulfonate | 10 | x | x | xx | Comp. |
| | | 30 | Δ | x | xx | |
| 3 | Sodium nonyldiphenyl ether disulfonate | 10 | x | x | xx | Comp. |
| | | 30 | x | x | xx | |
| 4 | Diethylene glycol | 10 | xx | x | xx | Comp. |
| | | 30 | x | x | xx | |
| 5 | Triethylene glycol | 10 | xx | x | xx | Comp. |
| | | 30 | Δ | x | xx | |
| 6 | Polyethylene glycol (average molecular weight: 400) | 10 | x | x | x | Comp. |
| | | 30 | Δ | x | x | |
| 7 | Polyethylene glycol (average molecular weight: 2,000) | 10 | x | x | x | Comp. |
| | | 30 | ○ | x | x | |

TABLE A-continued

| Sample No. | Compound Added | Addition Amount (g/l) | Precipitation | Heating 40° C. | Heating 50° C. | Remarks |
|---|---|---|---|---|---|---|
| 8 | Sodium propanesulfonate | 10 | x | x | x | Comp. |
| | | 30 | x | Δ | x | |
| 9 | Sodium undecanesulfonate | 10 | ○ | x | x | Comp. |
| | | 30 | ○ | Δ | Δ | |
| 10 | Comparative Compound-1 | 10 | x | x | x | Comp |
| | | 30 | ○ | Δ | x | |
| 11 | Comparative Compound-2 | 10 | x | x | x | Comp |
| | | 30 | ○ | Δ | x | |
| 12 | Ethyleneurea | 10 | ○ | ○ | ○ | Comp |
| | | 30 | ◎ | ◎ | ○ | |
| 13 | Exemplified Compound (I-3) | 10 | ○ | ○ | ○ | Inv. |
| | | 30 | ◎ | ◎ | ◎ | |
| 14 | Exemplified Compound (I-4) | 10 | ○ | ○ | ○ | Inv. |
| | | 30 | ◎ | ◎ | ◎ | |
| 15 | Exemplified Compound (I-9) | 10 | ○ | ○ | ○ | Inv |
| | | 30 | ◎ | ◎ | ◎ | |
| 16 | Ekemplified Compound (I-10) | 10 | ○ | ○ | ○ | Inv |
| | | 30 | ◎ | ◎ | ◎ | |
| 17 | Exemplified Compound (I-11) | 10 | ○ | ○ | ○ | Inv. |
| | | 30 | ◎ | ◎ | ◎ | |
| 18 | Exemplified Compound (II-3) | 10 | ○ | ○ | ○ | Inv. |
| | | 30 | ◎ | ◎ | ◎ | |
| 19 | Exemplified Compound (II-4) | 10 | ○ | ○ | ○ | Inv. |
| | | 30 | ◎ | ◎ | ◎ | |
| 20 | Exemplified Compound (II-5) | 10 | ○ | ○ | ○ | Inv. |
| | | 30 | ◎ | ◎ | ◎ | |
| 21 | Exemplified Compound (II-3)/diethylene glycol (mixing ratio: 4/1) | 10 | ◎ | ◎ | ◎ | Inv. |
| | | 30 | ◎ | ◎ | ◎ | |
| 22 | Exemplified Compound (I-10)/polyethylene glycol (average molecular weight: 2,000) (mixing ratio: 4/1) | 10 | ◎ | ◎ | ◎ | Inv. |
| | | 30 | ◎ | ◎ | ◎ | |
| 23 | Exemplified Compound (I-10)/Exemplified Compound (II-3) (mixing ratio: 4/1) | 10 | ◎ | ◎ | ◎ | Inv. |
| | | 30 | ◎ | ◎ | ◎ | |
| 24 | Exemplified Compound (I-10)/poly-N-vinyl pyrrolidone (mixing ratio: 4/1) | 10 | ◎ | ◎ | ◎ | Inv. |
| | | 30 | ◎ | ◎ | ◎ | |

Comparative Compound-1: $C_2H_5$—$(OC_2H_4)_3$—OH
Comparative Compound-2: $CH_3$—$(OC_2H_4)_3$—OH Comparative Sample Nos. 2 to 11 in which conventionally well-known compounds were used generated coloring either on the bottle or on the processing agent composition, hence did not show the coloring preventing effect, or a little even if effective, as compared with Comparative Sample No. 1 containing no precipitation preventing agent, while in Sample Nos. 13 to 24 of the present invention to each of which the compound of the present invention was added, a little coloring of the processing agent composition was observed in some samples, but coloring on the bottle was not observed at all, by which apparent effect of the compound according to the present invention was confirmed as compared with Comparative Sample Nos. 2 to 11. Further, the coloring preventing effect equal to or more than the precipitation preventing agent disclosed in JP-A-11-174643 (ethyleneurea in Sample No. 12) was confirmed. It was found from the results shown in Table A that excellent results could be obtained when the compound of the present invention was used in combination with diethylene glycol, polyethylene glycol or polyvinyl pyrrolidone, or when the compound represented by formula (I) and the compound represented by formula (II) were used in combination.

Example 3

Test of Photographic Performances

1. Color Negative Films Tested

Commercially available films shown below (all of them were manufactured by Fuji Photo Film Co., Ltd.) were used in the ratio as described below.

Film A: FUJICOLOR SUPER100 (a roll film of 24 exposures), manufacturer's serial number: V09140

Film B: FUJICOLOR SUPER400 (a roll film of 24 exposures), manufacturer's serial number: N24112

Film C: FUJICOLOR SUPER GACE800 (a roll film of 24 exposures), manufacturer's serial number: M74128

Film D: FUJICOLOR nexia H400 (a roll film of 40 exposures), manufacturer's serial number: CA56-303

These films were processed in the ratio of Film A/Film B/Film C/Film D=4/4/1/1.

2. Exposure for Photographic Performance Test

The above Sample Film B was subjected to exposure for sensitometry according to the method described in International Standard ISO5800 (a method for measuring sensitivity of a color negative film) through a standard C light source and a neutral color continuous wedge (density gradient: 0.4 ΔD/cm, density range: 0.02 to 4.8). This exposed sample was used in the following development processing and photographic properties (sensitivity, gradation and fog) were found.

3. Development Processing

Development processing was performed by means of the following development processor for a color negative film and the prescription.

Figure 2:
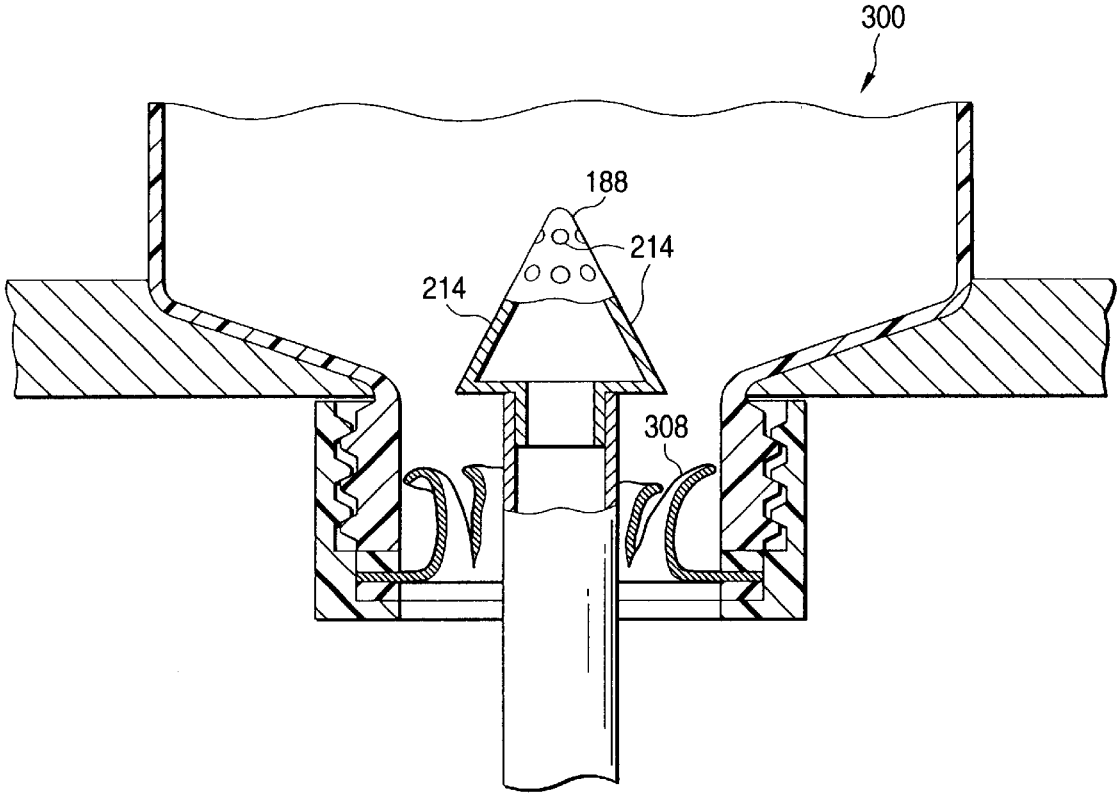
FIG. 2 is a view showing the state of a punching nozzle breaking the sealing part of a container (bottle) of a processing agent composition in one embodiment of the present invention.

As the processor, the processing time of an automatic processor FP-363SC (manufactured by Fuji Photo Film Co., Ltd.) was modified to make an experiment processor. The processor is provided with a replenishing mechanism by automatic stopper opening and automatic preparation system. The outline of the processor is described below. Plastic (HDPE) bottles described above (symbol 300 in FIG. 2, hereinafter each member is described by the symbol) are installed side by side with the opening down, and when the bottle is capped, as shown in FIG. 2, the bottle moves to punching nozzle 188 from the upside, punching nozzle 188 punches plastic sheet 380 functioning as a bottle cap, and the content of the bottle is injected into a replenisher tank Thereafter, a prescribed amount of washing water jets out from the nozzle hole 214 of punching nozzle 188 and the inside of the bottle is washed. The water used for washing is introduced to a replenisher tank and used as a dilution water to prepare a replenisher.

The processing step and the composition of each processing solution are shown below.

Processing Step

| Step | Processing Time | Processing Temperature (° C.) | Replenishment Rate* (ml) | Tank Capacity (liter) |
|---|---|---|---|---|
| Color Development | 2 min 30 sec | 41.0 | 15 | 10.3 |
| Bleaching | 25 sec | 40 | 5 | 3.6 |
| Fixing (1) | 25 sec | 40 | — | 3.6 |
| Fixing (2) | 25 sec | 40 | 7.5 | 3.6 |
| Stabilization (1) | 14 sec | 40 | — | 1.9 |
| Stabilization (2) | 13 sec | 40 | — | 1.9 |
| Stabilization (3) | 13 sec | 40 | 30 | 1.9 |
| Drying | 30 sec | 60 | | |

*Replenishing rate: per 1.1 meter of 35 mm wide photographic material (corresponding to a 24 Ex. film)

Stabilization was conducted in a countercurrent system from (3) to (2) to (1). Fixation was also conducted in a countercurrent system and fixing tanks were connected by countercurrent piping from (2) to (1). Tank solution of stabilization tank (2) was introduced to fixing tank (2) (15 ml corresponding to replenishing amount). Further, the amount of the carryover of the developing solution into the bleaching step, the amount of the carryover of the bleaching solution to the fixing step, and the amount of the carryover of the fixing solution to the washing step were each 2.0 ml per 1.1 meter of 35 mm wide photographic material. Further, the crossover time was 6 seconds in each case, and this time was included in the processing time of the previous step.

The composition of each processing solution is described below.

Color Developing Solution

| | Tank Solution | Replenisher |
|---|---|---|
| Diethylenetriaminepentaacetic Acid | 2.0 g | 4.0 g |
| Sodium 4,5-Dihydroxybenzene-1,3-disulfonate | 0.4 g | 0.5 g |
| Disodium-N,N-bis(sulfonatoethyl)-hydroxylamine | 10.0 g | 15.0 g |
| Sodium Sulfite | 4.0 g | 9.0 g |
| Potassium Bromide | 1.4 g | — |
| 4-Amino-3-methyl-N-ethyl-N-(β-hydroxyethyl)aniline Sulfate | 5.5 g | 12.5 g |
| Potassium Carbonate | 39 g | 59 g |
| Compound described in Table B | (see Table B) | (see Table B) |
| Water to make | 1.0 l | 1.0 l |
| pH (adjusted with sulfuric acid and KOH) | 10.10 | 11.20 |

Bleaching Solution

| | Tank Solution | Replenisher |
|---|---|---|
| Ammonium 1,3-Diaminopropanetetra-acetato Ferrate Monohydrate | 120 g | 180 g |
| Ammonium Bromide | 50 g | 70 g |
| Succinic Acid | 30 g | 50 g |
| Maleic Acid | 40 g | 60 g |
| Imidazole | 20 g | 30 g |
| Water to make | 1.0 l | 1.0 l |
| pH (adjusted with aqueous ammonia and nitric acid) | 4.6 | 4.0 |

Fixing Solution

| | Tank Solution | Replenisher |
|---|---|---|
| Ammonium Thiosulfate (750 g/liter) | 280 ml | 750 ml |
| Aqueous Ammonium Bisulfite Solution (72%) | 20 g | 80 g |
| Imidazole | 5 g | 45 g |
| 1-Mercapto-2-(N,N-dimethylamino-ethyl) tetrazole | 1 g | 3 g |
| Ethylenediaminetetraacetic Acid | 8 g | 12 g |
| Water to make | 1.0 l | 1.0 l |
| pH (adjusted with aqueous ammonia and nitric acid) | 7.0 | 7.0 |

Stabilizing Solution (replenisher equals tank solution)

| | |
|---|---|
| Sodium p-Toluenesulfinate | 0.03 g |
| p-Nonylphenoxypoly Glycidol (average polymerization degree of glycidol: 10) | 0.4 g |
| Disodium Ethylenediaminetetraacetate | 0.05 g |
| 1,2,4-Triazole | 1.3 g |
| 1,4-Bis(1,2,4-triazol-1-ylmethyl)-piperazine | 0.75 g |
| 1,2-Benzisothiazolin-3-one | 0.10 g |
| Water to make | 1.0 l |
| pH | 8.5 |

4. Test and Results of Test

A five time concentrated solution of the color developing replenisher prescription described in the development processing condition in the above item 3 was prepared. ("Concentration" in a liquid processing agent is terminology meaning the ratio to the value in prescription of the concentration of the processing agent composition and not means the concentration due to evaporation and the like.) The concentrated developing replenisher composition was poured into the above plastic bottles (HDPE) and aged at 40° C. for 10 weeks. The bottles were installed at the replenisher-preparing part of the above modified processor, and the concentrated developing replenisher composition was discharged from each plastic bottle to the replenisher tank according to the above-described method, diluted with washing water, thus a replenisher was prepared in each replenisher tank. Each of the above tank solutions prepared separately was poured into the processor, and 30% exposed film of the above film was processed (30% exposure was due to the fact that the sensitivity rate of the silver halide grains under average photographing conditions of color negative films is 30%), with replenishing from the replenisher tank. When the amount of the used developing replenisher reached 1.0 time of the developing tank capacity, the test piece of the above film B exposed through wedge exposure for sensitometry was subjected to development processing and the photographic properties were compared with the photographic properties processed by standard processing shown below. The processing step and the processing solution compositions of standard processing are shown below. Except color developing solution, processing solutions having the same compositions as above were used in processing.

Processing Step

| Step | Processing Time | Processing Temperature (° C.) | Replenishment Rate* (ml) | Tank Capacity (liter) |
|---|---|---|---|---|
| Color Development | 3 min 05 sec | 38.0 | 15 | 10.3 |
| Bleaching | 50 sec | 38 | 5 | 3.6 |
| Fixing (1) | 50 sec | 38 | — | 3.6 |
| Fixing (2) | 50 sec | 38 | 7.5 | 3.6 |
| Stabilization (1) | 30 sec | 38 | — | 1.9 |
| Stabilization (2) | 20 sec | 38 | — | 1.9 |
| Stabilization (3) | 20 sec | 38 | 30 | 1.9 |
| Drying | 1 min 30 sec | 60 | | |

*Replenishing rate: per 1.1 meter of 35 mm wide photographic material (corresponding to a 24 Ex. film)

Stabilization was conducted in a countercurrent system from (3) to (2) to (1). Fixation was also conducted in a countercurrent system and fixing tanks were connected by countercurrent piping from (2) to (1). Tank solution of stabilization tank (2) was introduced to fixing tank (2) (15 ml corresponding to replenishing amount) Further, the amount of the carryover of the developing solution into the bleaching step, the amount of the carryover of the bleaching solution to the fixing step, and the amount of the carryover of the fixing solution to the washing step were each 2.0 ml per 1.1 meter of 35 mm wide photographic material. Further, the crossover time was 6 seconds in each case, and this time was included in the processing time of the previous step.

The composition of each processing solution is described below.

Color Developing Solution

| | Tank Solution | Replenisher |
|---|---|---|
| Diethylenetriaminepentaacetic Acid | 2.0 g | 4.0 g |
| Sodium 4,5-Dihydroxybenzene-1,3-disulfonate | 0.4 g | 0.5 g |
| Disodium-N,N-bis(sulfonatoethyl)-hydroxylamine | 10.0 g | 15.0 g |
| Sodium Sulfite | 4.0 g | 9.0 g |
| Potassium Bromide | 1.4 g | — |
| Diethylene Glycol | 10.0 g | 17.0 g |
| Ethyleneurea | 3.0 g | 5.5 g |
| 4-Amino-3-methyl-N-ethyl-N-(β-hydroxyethyl)aniline Sulfate | 4.7 g | 11.4 g |
| Potassium Carbonate | 39 g | 59 g |
| Hydroxylamine Sulfate | 2.0 g | 4.0 g |
| Water to make | 1.0 l | 1.0 l |
| pH (adjusted with sulfuric acid and KOH) | 10.07 | 10.51 |

Photographic properties were compared as follows. That is, each test piece after being processed (a sample wedge exposed for sensitometry) was represented by the following color balance difference. The nearer to 0 is the color balance difference, it means that the color balance by test processing is finished equal to the color balance by standard processing. The results obtained are shown in Table B.

Color balance difference: Δ(R-G)=[(R density at test processing time)−(G density at test processing time)]−[(R density at standard processing time)−(G density at standard processing time)]

Each R density and G density is the density at logarithmic exposure amount (logE) of 3.0 (anti-logarithmic value of the exposure amount is 1,000 cms).

TABLE B

| Sample No. | Compound Added | Addition Amount (g/liter) | Color Balance Δ (R − G) | Remarks |
|---|---|---|---|---|
| 1 | Non | — | −0.4 | Comparison |
| 2 | Sodium p-toluenesulfonate | 20 | −0.25 | Comparison |
| | | 40 | −0.25 | |
| 3 | Sodium nonyldiphenyl ether disulfonate | 20 | −0.23 | Comparison |
| | | 49 | −0.24 | |
| 4 | Diethylene glycol | 20 | −0.26 | Comparison |
| | | 40 | −0.25 | |
| 5 | Triethylene glycol | 20 | −0.27 | Comparison |
| | | 40 | −0.26 | |
| 6 | Polyethylene glycol (average molecular weight: 400) | 20 | −0.21 | Comparison |
| | | 40 | −0.21 | |
| 7 | Polyethylene glycol (average molecular weight: 2,000) | 20 | −0.26 | Comparison |
| | | 40 | −0.25 | |
| 8 | Sodium propanesulfonate | 20 | −0.21 | Comparison |
| | | 40 | −0.22 | |
| 9 | Sodium undecanesulfonate | 20 | −0.22 | Comparison |
| | | 40 | −0.22 | |
| 10 | Comparative Compound-1 | 20 | −0.21 | Comparison |
| | | 40 | −0.20 | |
| 11 | Comparative Compound-2 | 20 | −0.24 | Comparison |
| | | 40 | −0.23 | |
| 12 | Ethyleneurea | 20 | −0.25 | Comparison |
| | | 40 | −0.24 | |
| 13 | Exemplified Compound (I-3) | 20 | −0.19 | Invention |
| | | 40 | −0.15 | |
| 14 | Exemplified Compound (I-4) | 20 | −0.18 | Invention |
| | | 40 | −0.16 | |
| 15 | Exemplified Compound (I-9) | 20 | −0.11 | Invention |
| | | 40 | −0.10 | |
| 16 | Exemplified Compound (I-10) | 20 | −0.09 | Invention |
| | | 40 | −0.08 | |
| 17 | Exemplified Compound (I-11) | 20 | −0.10 | Invention |
| | | 40 | −0.08 | |
| 18 | Exemplified Compound (II-3) | 20 | −0.08 | Invention |
| | | 40 | −0.06 | |
| 19 | Exemplified Compound (II-4) | 20 | −0.10 | Invention |
| | | 40 | −0.08 | |
| 20 | Exemplified Compound (II-5) | 20 | −0.12 | Invention |
| | | 40 | −0.10 | |
| 21 | Exemplified Compound (II-3)/diethylene glycol (mixing ratio: 4/1) | 20 | −0.06 | Invention |
| | | 40 | −0.04 | |
| 22 | Exemplified Compound (I-10)/polyethylene glycol (average molecular weight: 2,000) (mixing ratio: 4/1) | 20 | −0.05 | Invention |
| | | 40 | −0.05 | |
| 23 | Exemplified Compound (I-10)/Exemplified Compound (II-3) (mixing ratio: 4/1) | 20 | −0.06 | Invention |
| | | 40 | −0.04 | |
| 24 | Exemplified Compound (I-10)/poly-N-vinyl pyrrolidone (mixing ratio: 4/1) | 20 | −0.05 | Invention |
| | | 40 | −0.05 | |

Comparative Compound-1: $C_2H_5$—$(OC_2H_4)_3$—OH
Comparative Compound-2: $CH_3$—$(OC_2H_4)_3$—OH It can be understood from the results in Table B that photographic properties were maintained stably by the addition of the compound represented by formula (I) or (II) even during storage of the developer composition. Further, conspicuous color balance improving effect of the present invention was observed as compared with the precipitation preventing agent disclosed in JP-A-11-174643 (ethyleneurea in Sample No. 12). It was found from the results shown in Table B that excellent results could be obtained when the compound represented by formula (I) or (II) was used in combination with diethylene glycol, polyethylene glycol or polyvinyl pyrrolidone, or when the compound represented by formula (I) and the compound represented by formula (II) were used in combination.

Example 4

1. Color Negative Film Sample for Test

The following test was conducted using Sample No. 101 in Example 1 of U.S. Pat. No. 6,013,426 as a test photographic material.

2. Preparation of Concentrated Color Developer and Stability Test of Composition A color developing replenisher was prepared each containing color developing replenisher prescription described later in the item of development processing test, the compound represented by formula (I), (II) or comparative compound shown in Table C. Each of the above-obtained color developer composition was concentrated to three times and put in an HDPE bottle (one part constitution). Thus, Composition Sample Nos. 31 to 47 were obtained.

The stability to precipitation of Sample Nos. 31 to 47 with the lapse of time under a sealed condition in a bottle and the stability to air oxidation were examined according to the methods described in Examples 1 and 2. The test condition of 40° C. was selected with respect to the test of the stability to coloring.

The results obtained are shown in Table C.

3. Test of Photographic Properties

Photographic properties with pretreatment running of Photographic Material Sample No. 101 were tested using the same processor, processing step, exposure and processing operation as in Example 3 except that Sample No. 101 was used for sensitometry exposure and running equilibrium arrival of the tank solution in the processor, that the transporting speed of the processor used in Example 3 was increased by 10% and the temperature of each processing step was changed therewith, that the color developing solution shown below was used as the color developing tank solution, and the concentrated color developer prepared by the following prescription was put in the above-described bottle, installed in the processor in the same manner as described in Example 3, and the automatically prepared replenisher thereby was used as the color developing replenisher, and that the stabilizing solution of the common prescription described below was used as the stabilizing tank solution and the replenisher thereof. The evaluation of photographic properties was performed according to the same method as in Example 3, i.e., photographic properties were evaluated by color balance difference from standard development as the representative value of photographic properties.

The results obtained are shown in Table C.

The processing step and the composition of each processing solution are shown below.

Processing Step

| Step | Processing Time (sec) | Processing Temperature (° C.) | Replenishment Rate* (ml) | Tank Capacity (liter) |
|---|---|---|---|---|
| Color Development | 135 | 42.0 | 15 | 10.3 |
| Bleaching | 22.5 | 41 | 5 | 3.6 |
| Fixing (1) | 22.5 | 41 | — | 3.6 |
| Fixing (2) | 22.5 | 41 | 7.5 | 3.6 |
| Stabilization (1) | 12.6 | 41 | — | 1.9 |
| Stabilization (2) | 11.7 | 41 | — | 1.9 |
| Stabilization (3) | 11.7 | 41 | 30 | 1.9 |
| Drying | 27 | 62 | | |

*Replenishing rate: per 1.1 meter of 35 mm wide photographic material (corresponding to a 24 Ex. film)

Stabilization was conducted in a countercurrent system from (3) to (2) to (1). Fixation was also conducted in a countercurrent system and fixing tanks were connected by countercurrent piping from (2) to (1). Tank solution of stabilization tank (2) was introduced to fixing tank (2) (15 ml corresponding to replenishing amount) Further, the amount of the carryover of the developing solution into the bleaching step, the amount of the carryover of the bleaching solution to the fixing step, and the amount of the carryover of the fixing solution to the washing step were each 2.0 ml per 1.1 meter of 35 mm wide photographic material. Further, the crossover time was 5.4 seconds in each case, and this time was included in the processing time of the previous step.

The composition of each processing solution is described below.

Color Developing Solution

| | Tank Solution | Replenisher |
|---|---|---|
| Diethylenetriaminepentaacetic Acid | 2.8 g | 3.4 g |
| Disodium Catechol-3,5-disulfonate | 0.27 g | 0.35 g |
| Sodium Sulfite | 3.9 g | 5.3 g |
| Potassium Carbonate | 39.0 g | 39.0 g |
| Compound described in Table C (see Table C) | 4.7 g | 6.0 g |
| Disodium-N,N-bis(2-sulfonato-ethyl) hydroxylamine | 1.5 g | 2.0 g |
| Potassium Bromide | 1.3 g | 0.3 g |
| Potassium Iodide | 1.3 mg | — |
| 4-Hydroxy-6-methyl-1,3,3a,7-tetraazaindene | 0.05 g | — |
| Hydroxylamine Sulfatet | 2.4 g | 3.3 g |
| 2-Methyl-4-[N-ethyl-N-(β-hydroxyethyl) amino] aniline Sulfate | 4.5 g | 6.5 g |
| Water to make | 1.0 l | 1.0 l |
| pH (adjusted with potassium hydroxide and sulfuric acid) | 10.05 | 10.18 |

Stabilizing Solution (replenisher equals tank solution)

| | |
|---|---|
| Sodium p-Toluenesulfinate | 0.03 g |
| p-Nonylphenoxypoly Glycidol (average polymerization degree of glycidol: 10) | 0.4 g |
| Disodium Ethylenediaminetetraacetate | 0.05 g |

-continued

| Stabilizing Solution (replenisher equals tank solution) | |
|---|---|
| 1,2-Benzisothiazolin-3-one | 0.10 g |
| Water to make | 1.0 l |
| pH | 8.5 |

As described above, prescription of the processing solutions in a bleaching step and a fixing step (and replenisher) are the same as those in Example 3.

TABLE C

| Sample No. | Compound Added | Precipitation | Coloring (40° C.) | Color Balance | Remarks |
|---|---|---|---|---|---|
| 31 | None | xx | xx | −0.30 | Comp. |
| 32 | Polyethylene glycol (average molecular weight: 1,000) | Δ | Δ | −0.27 | Comp. |
| 33 | Ethyleneurea | Δ | Δ | −0.25 | Comp. |
| 34 | Poly-N-vinyl pyrrolidone | Δ | Δ | −0.25 | Comp. |
| 35 | Exemplified Compound (I-10) | ○ | ○ | −0.18 | Inv. |
| 36 | Exemplified Compound (II-2) | ○ | ○ | −0.15 | Inv. |
| 37 | Exemplified Compound (II-5) | ○ | ○ | −0.14 | Inv. |
| 38 | Exemplified Compound (I-10)/polyethylene glycol (mixing ratio: 4/1) | ○ | ◎ | −0.10 | Inv. |
| 39 | Exemplified Compound (I-10)/ethyleneurea (mixing ratio: 4/1) | ◎ | ○ | −0.13 | Inv. |
| 40 | Exemplified Compound (I-10)/poly-N-vinyl pyrrolidone (mixing ratio: 4/1) | ◎ | ○ | −0.12 | Inv. |
| 41 | Exemplified Compound (II-2)/polyethylene glycol (mixing ratio: 4/1) | ◎ | ◎ | −0.05 | Inv. |
| 42 | Exemplified Compound (II-2)/ethyleneurea (mixing ratio: 4/1) | ◎ | ◎ | −0.05 | Inv. |
| 43 | Exemplified Compound (II-2)/poly-N-vinyl pyrrolidone (mixing ratio: 4/1) | ◎ | ◎ | −0.04 | Inv. |
| 44 | Exemplified Compound (II-5)/polyethylene glycol (mixing ratio: 4/1) | ◎ | ◎ | −0.06 | Inv. |
| 45 | Exemplified Compound (II-5)/ethyleneurea (mixing ratio: 4/1) | ◎ | ◎ | −0.05 | Inv. |
| 46 | Exemplified Compound (II-5)/poly-N-vinyl pyrrolidone (mixing ratio: 4/1) | ◎ | ◎ | −0.05 | Inv. |
| 47 | Exemplified Compound (I-10)/Exemplified Compound (II-3) (mixing ratio: 1/1) | ◎ | ◎ | −0.10 | Inv. |

Note:
(1)Polyethylene glycol used had an average molecular weight of 1,000.
(2)Addition amount of each compound was 30 g/liter, and when two kinds of compounds were added, the total amount was 30 g/liter.

4. Test Results

It can be seen from the results in Table C that color balance difference between every of Sample Nos. 35 to 46 according to the present invention subjected to high temperature, short time rapid development and Comparative Sample No. 1 processed under standard development condition is 0.18 or less, further when the compound according to the present invention is combined with polyethylene glycol, urea or polyvinyl pyrrolidone, color balance difference is 0.13 or less, which improves that the present samples are excellent in image quality.

Further from the results in Table C, when Sample Nos. 35 to 37 are compared with Comparative Sample Nos. 32 to 34, it can be seen that the samples according to the present invention in which the compound represented by formula (I) or (II) is added are superior to comparative samples using conventionally known comparative compound in all of crystal precipitation resistance, coloring prevention and photographic properties. When the samples according to the present invention are compared, i.e., Sample No. 35 with Sample Nos. 38 to 40, Sample No. 36 with Sample Nos. 41 to 43, and Sample No. 37 with Sample Nos. 44 to 46, if ethylene glycol, ethyleneurea, or polyvinyl pyrrolidone is further added to the compound represented by formula (I) or (II), the effect of the present invention are enhanced. Further, when Sample Nos. 38 to 40 are compared with Sample Nos. 41 to 43, and Sample Nos. 44 to 46, respectively, if ethylene glycol, ethyleneurea, or polyvinyl pyrrolidone is combined with the compound represented by formula (II), the effect of the present invention, in particular, concerning the stability of the photographic properties, becomes more conspicuous than the time when combined with the compound represented by formula (I).

EFFECT OF THE INVENTION

By the addition of the compound represented by formula (I) or (II) to the color developer composition for a silver halide color photographic material, the precipitation of the composition during preservation and coloring of the composition itself or coloring of the container thereof can be prevented, and stable photographic performance can be maintained. Accordingly, the concentration of the color developer composition can be increased.

Further, it becomes possible to use polyethylene containers which cannot be used conventionally for a color developer composition.

In addition, when the concentrated liquid development processing agent according to the present invention is diluted and used as a developing solution or a developing replenisher, the deterioration of color balance which is liable to occur at rapid development can be improved. In particular, color balance improving effect is particularly effectively exhibited in rapid and/or high temperature color development processing of 2 minutes and 30 seconds or less and/or at 40° C. or more.

These effects are further increased when the compound represented by formula (I) or (II), particularly formula (II), is used in combination with conventionally well-known polyethylene glycols, ethyleneureas or polyvinyl pyrrolidones.

While the invention has been described in detail and with reference to specific examples thereof, it will be apparent to one skilled in the art that various changes and modifications can be made therein without departing from the spirit and scope thereof.

What is claimed is:

1. A concentrated liquid color developer composition for a silver halide color photographic material which comprises at least one compound represented by the following formula (I) or (II):

$$R^1—(OC_2H_4)_n—OH \quad (I)$$

wherein $R^1$ represents an alkyl group having from 1 to 3 carbon atoms, and n represents an integer of from 4 to 9;

$$R^2—SO_3M \quad (II)$$

wherein $R^2$ represents an alkyl group having from 4 to 10 carbon atoms, and M represents a cation.

2. The concentrated liquid color developer composition as claimed in claim 1, wherein said concentrated liquid color developer composition contains at least one compound represented by formula (II), and at least one compound selected from polyethylene glycol (provided that the polyethylene glycol has a number average molecular weight of 2,000 or less), ureas, and polyvinyl pyrrolidones.

3. The concentrated liquid color developer composition as claimed in claim 1 or 2, wherein said concentrated liquid color developer composition is contained in a container.

4. A development processing method of a silver halide color photographic material which comprises performing color development using a color developing solution or a color developing replenisher obtained by diluting a concentrated liquid color developer composition for a silver halide color photographic material which comprises at least one compound represented by the following formula (I) or (II):

$$R^1—(OC_2H_4)_n—OH \quad (I)$$

wherein $R^1$ represents an alkyl group having from 1 to 3 carbon atoms, and n represents an integer of from 4 to 9;

$$R^2—SO_3M \quad (II)$$

wherein $R^2$ represents an alkyl group having from 4 to 10 carbon atoms, and M represents a cation, within processing time of 2 minutes and 30 seconds.

5. A development processing method of a silver halide color photographic material which comprises performing color development using a color developing solution or a color developing replenisher obtained by diluting a concentrated liquid color developer composition for a silver halide color photographic material which comprises at least one compound represented by the following formula (I) or (II):

$$R^1—(OC_2H_4)_n—OH \quad (I)$$

wherein $R^1$ represents an alkyl group having from 1 to 3 carbon atoms, and n represents an integer of from 4 to 9;

$$R^2—SO_3M \quad (II)$$

wherein $R^2$ represents an alkyl group having from 4 to 10 carbon atoms, and M represents a cation, at processing temperature of 40° C. or more.

* * * * *